US007222853B2

(12) United States Patent
Duse

(10) Patent No.: US 7,222,853 B2
(45) Date of Patent: May 29, 2007

(54) METHOD AND CASINO GAMING TABLE FOR PLAYING THREE HAND PINOCHLE

(75) Inventor: Phillip Melvin Duse, Altoona, PA (US)

(73) Assignee: Phillip M. Duse, Sr., Altoona, PA (US)

( * ) Notice: Subject to any disclaimer, the term of this patent is extended or adjusted under 35 U.S.C. 154(b) by 239 days.

(21) Appl. No.: 11/138,879

(22) Filed: May 27, 2005

(65) Prior Publication Data

US 2006/0267282 A1 Nov. 30, 2006

(51) Int. Cl.
*A63F 3/08* (2006.01)

(52) U.S. Cl. ..... 273/274

(58) Field of Classification Search ..... 273/274
See application file for complete search history.

(56) References Cited

U.S. PATENT DOCUMENTS 5,791,652 A * 8/1998 Nielsen ..... 273/305
2006/0135238 A1* 6/2006 Lancaster et al. ..... 463/12

* cited by examiner

*Primary Examiner*—Eugene Kim
*Assistant Examiner*—Dolores R. Collins

(57) ABSTRACT

A casino-adapted wagering game that employs a Pinochle deck of eighty cards in conjunction with a gaming table, finalist board, and statistically derived payout schedules. The game as envisioned here is typically played by at least nine players in groups of three, who tally melt and card points to score at least as many points as the amount of the bid tabled by the highest bidder.

17 Claims, 6 Drawing Sheets

Figure 1: Flowchart of a pinochle-type card game
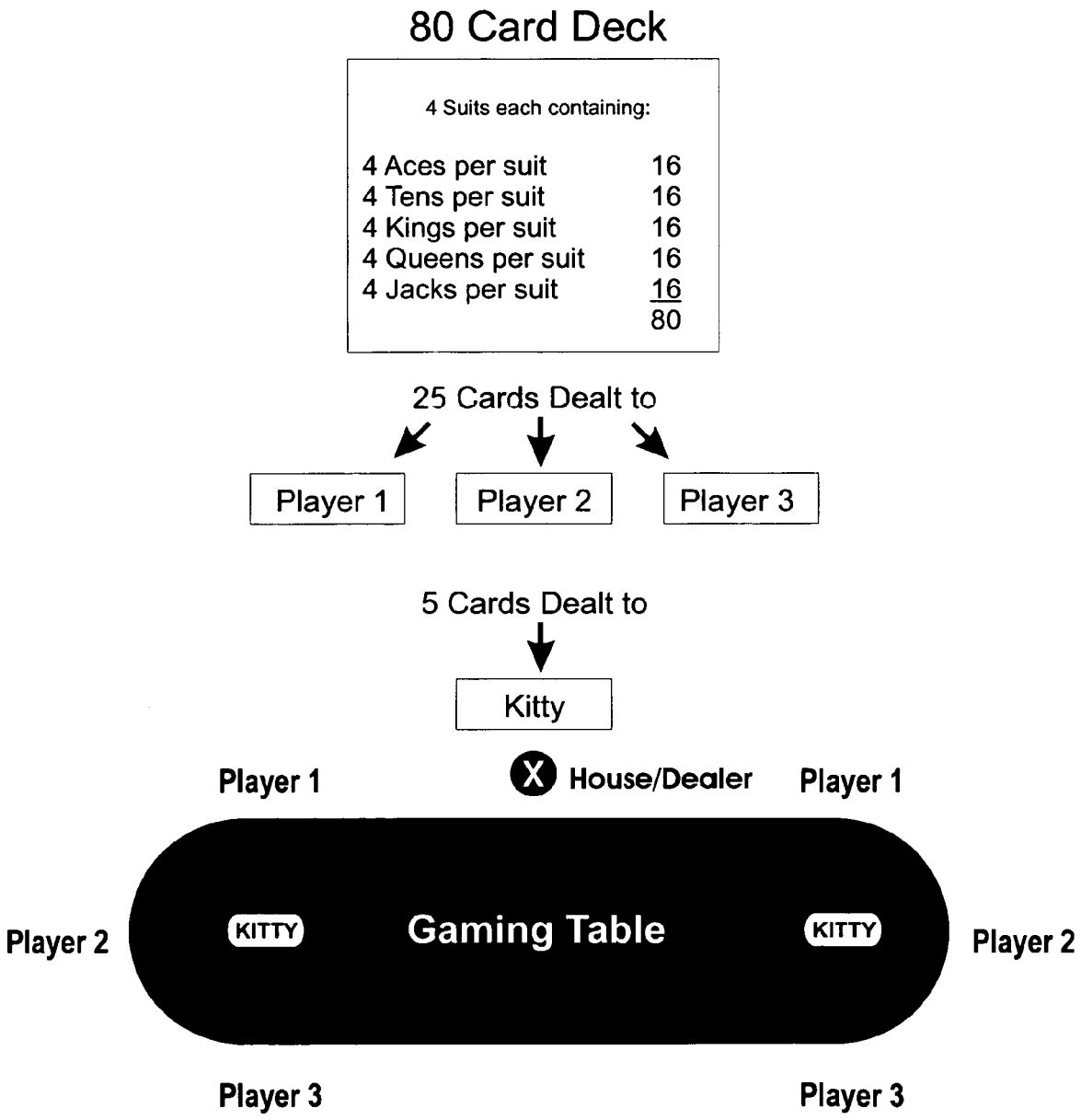

Figure 2: Top view of Gaming Table
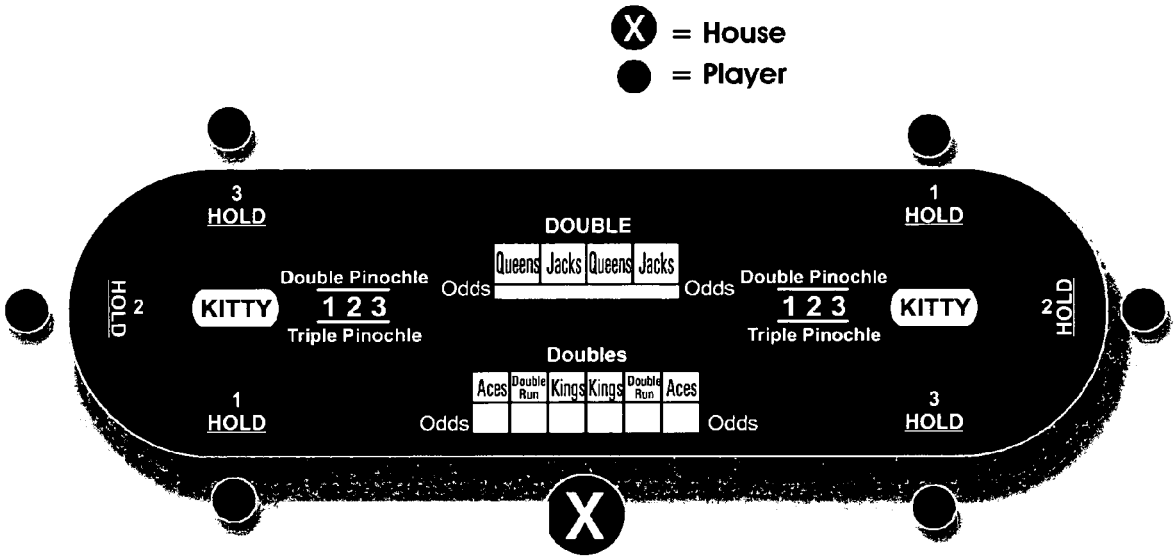

Figure 3: View of Leader Board
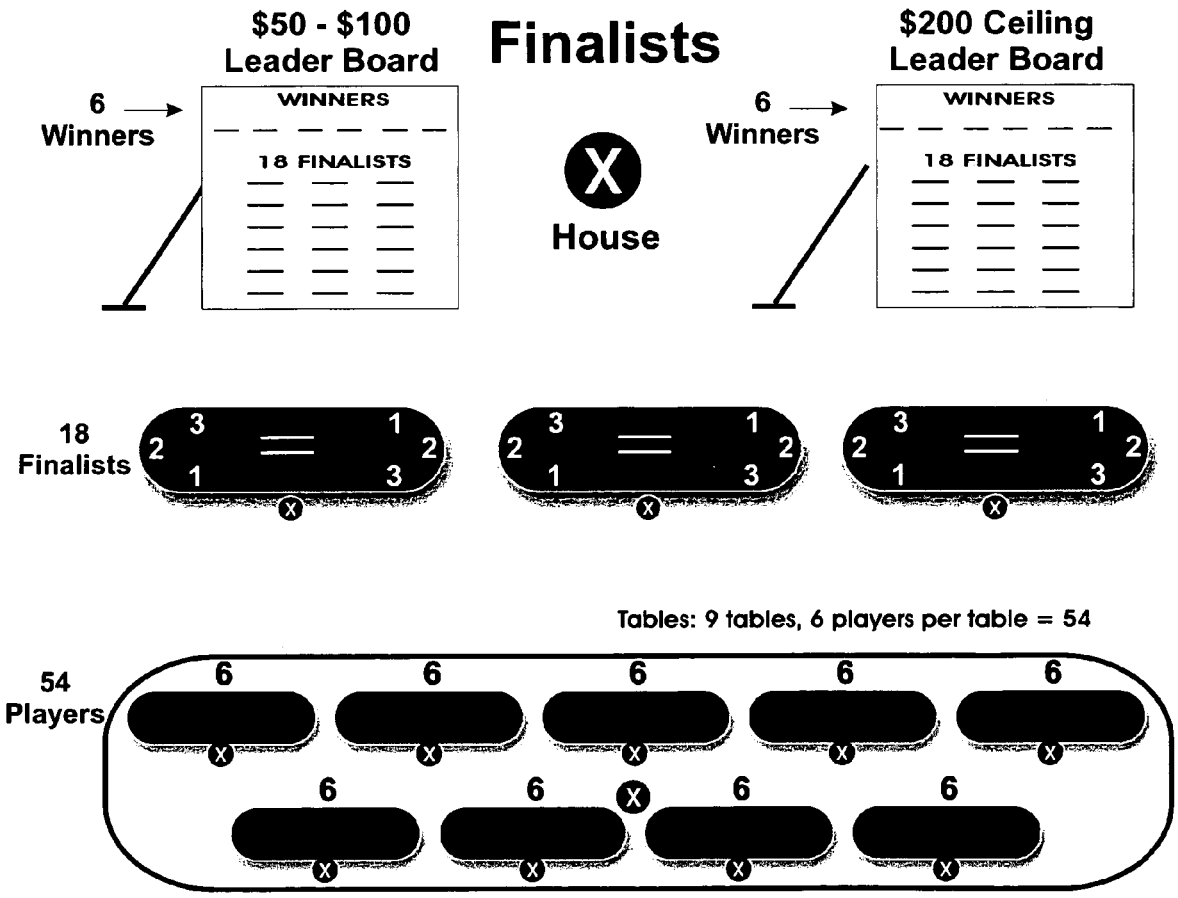

Level 2 (Figure 4-A) THREE HAND PINOCHLE SCORE SHEET 0F Pages

SCORE TO WIN GAME _____DATE OF PLAY_____PLAY IS AT LEVEL_____

PLAYERS: (1)_____(2)_____(3)_____

1 2 3 1 2 3

DEALER ( ) BID____[right side only]
HIGH BIDDER_____

MELT_____/_____/_____ DEALER( )BID____ MELT_____/_____/_____
HIGH BIDDER____

POINTS_____/_____/_____ POINTS_____/_____/_____

SET / OPPS

MINUS?_____/_____/_____ MINUS?_____/_____/_____

TOTAL_____/_____/_____ TOTAL_____/_____/_____

DEALER ( ) BID____[right side only]
HIGH BIDDER_____

MELT_____/_____/_____/DEALER( )BID___ MELT_____/_____/_____
HIGH BIDDER____

POINTS_____/_____/_____/ POINTS_____/_____/_____

SET /OPPS

MINUS?_____/_____/_____/ MINUS?_____/_____/_____

TOTAL_____/_____/_____/ TOTAL_____/_____/_____

DEALER ( ) BID____[right side only]
HIGH BIDDER_____

MELT_____/_____/_____/DEALER( ) BID____ MELT_____/_____/_____
HIGH BIDDER_____

POINTS_____/_____/_____/ POINTS_____/_____/_____

SET / OPPS

MINUS?_____/_____/_____/ MINUS?_____/_____/_____

TOTAL_____/_____/_____/ TOTAL_____/_____/_____

DEALER ( ) BID____[right side only]
HIGH BIDDER_____

MELT_____/_____/_____/DEALER( )BID____ MELT_____/_____/_____
HIGH BIDDER_____

POINTS_____/_____/_____/ POINTS_____/_____/_____

SET / OPPS

MINUS?_____/_____/_____/ MINUS?_____/_____/_____

TOTAL_____/_____/_____/ TOTAL_____/_____/_____

DEALER ( ) BID____[right side only]
HIGH BIDDER_____

MELT_____/_____/_____/DEALER( )BID_____MELT_____/_____/_____

POINTS_____/_____/_____/ POINTS_____/_____/_____

SET / OPPS

MINUS?_____/_____/_____/ MINUS?_____/_____/_____

TOTAL_____/_____/_____/ TOTAL_____/_____/_____

Figure 4 B

[1,2,3, ENTER NAME] TALLY SHEET [1,2,3 ENTER NAME]

Dealer initials

1_____2_____3_____and BID 1_____2_____3_____

___1___
___2___
___3___
___4___
___5___
___6___
___7___
___8___
___9___
___10___
___11___
___12___
___13___
___14___
___15___
___16___
___17___
___18___
___19___
___20___
___21___
___22___
___23___
___24___
___25___

(CIRCLE SETS)

Date _____Pg___

METHOD AND CASINO GAMING TABLE FOR PLAYING THREE HAND PINOCHLE

FIELD OF THE INVENTION

The present invention relates to method and gaming table design for playing three-hand-pinochle at a licensed casino gaming facility.

BACKGROUND OF THE INVENTION

Casinos and other establishments licensed to conduct gaming activity feature a number of wagering games that attract both novice and sophisticated players. In general, the most popular games are those which players find to be understandable, intellectually stimulating and exciting, with reasonable odds of winning. Card games, in particular, have achieved a high level of public acceptance because of their familiarity, readily understood methods of play, well-understood odds of winning, and unique ability to maintain the interest of players from all walks of life. Casinos, therefore, endeavor to include new and modified versions of card games in their collection of wagering games. Accordingly, there is an ongoing need for card games suitable for attracting and retaining a large number of players, and generating fair profits for the casino during the course of play.

The game of Pinochle, derived from the European game Bezique, is one of the United States' favorite card games. Importantly, Pinochle is known to provide players with a combination of excitement and intellectual stimulation; accordingly, this unique pinochle game assigns all responsibility to individual players, [as opposed to a team] making the game ideal for use in a casino or gaming room.

SUMMARY OF THE INVENTION

The present invention comprises a method and apparatus for contestants playing three-hand-pinochle, employing an 80 card pinochle deck. They play the game in conjunction with table wagering on combinations of specific pinochle related point values, termed melt. The melt is derived from the initial 25 or 30 cards dealt to the three players comprising a contestant game group. There is a gaming table and leader board configured with the markings depicted herein in this casino contestant game; described here for play by nine to fifty-four players, grouped in three person playing groups; two playing groups per gaming table, nine tables to a 54 contestant game set. Each contestant seeks to be the first within the three person groups to score (melt) 250 points to win the game. The individuals within the three person groups who wins two of the maximum 4 games within a game set become "finalist;" eighteen finalist for 54 contestants; 12 for 36; 6 for 18 and 3 for 9 contestants. Contestant finalist are identified on a "Leader Board," to compete again to win two "finalist games" within the maximum four games of a finalist set. The winners of two games in the finalist round of play split the winner's pot: 6 winners in 54 contestants; 4 in 36; 2 in 18 and 1 in a 9 contestant game set.

Players start the game through a bidding process beginning at 50 increasing in increments of 5 to determine the highest bidder. The highest bidder wins a coveted 5 card kitty to develop additional melt combinations and names the trump of personal choice, but must replace the five card kitty, from un-melted cards, (or go set for the bid) before beginning the play of the hand. All players can wager on melt combinations at the outset of the hand and collect on successful wagers before the high bidder starts play of the hand. The high bidder's melt points and points captured/won during the play of the hand must at least equal the bid. Other players need to capture a minimum of 10 points in order to have their melt and captured/won points tallied to their respective scores. Failure of the high bidder to melt at least 20 points as well as capture a minimum of 20 points or not have a marriage—king and queen in trump suit—results in the high bidder automatically going set by the bid amount. Players with a negative score are limited in future bidding to the negative difference between their score and 250.

It is an objective of the present invention to provide an exciting and highly competitive game that features a statistically determinable payout schedule, no less than 75% on average, providing a reasonable profit potential for a host casino or other licensed gaming enterprise. These and other objects of the invention are further outlined in grater detail in the accompanying description and drawings.

BRIEF DESCRIPTION OF THE DRAWINGS

FIG. 1 is a flowchart of the three-hand-pinochle card game according to the present Invention:

FIG. 2 is a top view of the game table surface featuring the markings in accordance with the present invention:

FIG. 3 is a front view of a finalist/leader board featuring markings in accordance with the present invention; and FIGS. 4A & B are sample manually accomplished scoring sheets for use with this three-hand-pinochle Card game according to the present invention, or the house may elect to utilize a locally developed mechanical scoring device.

DETAILED DESCRIPTION OF THE INVENTION

The present invention comprises a method and apparatus for playing the Three-Hand-Pinochle card game at a casino utilizing a wagering table configured, essentially, as depicted in FIG. 2. The game/wagering table top is imprinted with dealer (casino) and player locations as well as gaming wager placement areas i.e. markings for combinations of melt "doubles around" Aces, Kings, Queens, Jacks and Double and Triple Pinochle bet placement are also imprinted on the game table. The 5 kitty cards are placed in the areas of the game table, marked "Kitty." The game, as depicted in the enclosures, is being played by 9, 18, 36 or 54 players arranged in groups of three, 6 per table. The game is played with a double deck of pinochle cards numbering eighty cards, 20 cards per suit. Each suit, in order of rank, consists of four Aces (highest), four Tens, four Kings, four Queens and four Jacks (lowest). There are two levels of competition contemplated by the present invention, namely, level 1 for new and social players and level 2 for competitive players.

In play of the game on the game table format of the present invention, players table an initial bid of at least 50 which the next player must best by a minimum of 5 bid points until no more bids are tabled. This bidding process results in a player who tables the highest bid to win the coveted five card kitty. Then the objective of the high bidder is to win at least the minimum number of game points, 20, to be tallied with at least 20 melt points and through play of the hand have a total point count that equals the tabled bid. This is accomplished by laying melt combinations of cards in his/her hand down at the outset of the hand and then winning sufficient countable card points, Aces, Tens and Kings in "tricks" (books of cards) to at least equal the tabled bid.

Before "tabling" a bid, players carefully weigh the probability of the power of the hand to capture enough points to make the tabled bid. A failure to do so results in a reduction in score equal to the bid. Score reduction, i.e. "setting" the bidder, is the primary goal of the opposing players. Therefore, a clear understanding of bidding strategy is essential to the bidding process for one to win the right to choose a trump, without being set.

The card point system according to the present invention is as follows: Aces, Tens and Kings are valued at one point each, twelve points per suit, totaling 48 points in a deck. Queens and Jacks have no independent point value but can be arrayed to denote a "melt" value as indicated in the point/melt chart provided herein. The player winning the last book of cards scores an additional two points, bringing the deck's total point value to 50 points.

The eighty card deck is thoroughly shuffled by a mechanical dealer, the house, or by one of the players. Either of the players may cut the cards, if a mechanical dealer is not used, but the person to the right of the dealer has the first cut option. The cards are not dealt until after they have been cut—with the exception of cards dealt mechanically. At the dealer's option, the cards may be dealt sequentially to each player three, four or five cards at a time, with each player receiving twenty-five cards and the designated Kitty area receives five kitty cards. The player cards are placed face down on the gaming table (FIG. 2) in front of each player, while the kitty-cards are dealt face down into the area so designated, FIG. 2. Once the 25 cards are dealt, each player is permitted to view his/her cards and must claim successful wagers after a trump has been named but before the high bidder starts play of the hand.

As mentioned, the objective of the game is for each player to tally the value of point cards won in tricks with melt combinations of cards held by each player. Melting (result of a melding process) refers to the point values assigned to these combinations of cards, which must be tabled (revealed) by each player after the highest bidder claims the five kitty cards, the object of the bidding process, and chooses the trump suit of his/her choice. The melt possibilities and point values are as follows:

MELT POINT CHART

| Cards | Melt Combinations | Point value |
|---|---|---|
| Aces | Single Ace in each suit | 10 |
| | Double Aces in each suit | 100 |
| Tens | | Tens have no melt value |
| Kings | Single Kings in each suit | 8 |
| | Double Kings in each suit | 80 |
| Queens | Single Queen in each suit | 6 |
| | Double Queens in each suit | 60 |
| Jacks | Single Jack in each suit | 4 |
| | Double Jacks in each suit | 40 |
| King & Queen same suit | Non trump suit | 2 points each |
| King & Queen in Trump suit | In Trump Suit | 4 points each |
| Single Run: Ace, Ten, King, Queen & Jack in suit declared Trumps | Suit declared Trumps only, 4 additional points for each additional marriage | 15 + 4 per additional marriage |
| Double Run: 2 Aces, Tens, Kings, Queens, and Jacks in suit declared Trumps | Suit declared Trumps only, 4 additional points for each additional marriage | 150 + 4 per additional marriage |

-continued

MELT POINT CHART

| Cards | Melt Combinations | Point value |
|---|---|---|
| Round House: King and Queen in each suit | Regardless of Trump | 24 |
| Round House and a Run: Ace, Ten, King, Queen and Jack in trump suit plus King and Queen in other three suits | Run must be in Trumps | 35 |
| Single (Little) Pinochle: Queen of Spades and Jack of Diamonds | Regardless of trump suit | 4 |
| Double Pinochle: 2 Queens of Spades and 2 Jacks of Diamonds | Regardless of trump suit | 30 |
| Triple Pinochle: 3 Queens of Spades and 3 Jacks of Diamonds | Regardless of trump suit | 90 |
| Triple Aces, triple Kings, triple Queens or triple Jacks around | Each occurrence | 250 |

Melt Combinations and Exceptions

Calculation of Double Kings or Queens Around to Avoid Double Counting: The single point value of double Kings or Queens may not be counted a second time in a round house except for marriage values. That is, if a player has double Kings or Queens and a round house, the player receives 80 points for the Kings or 60 points for the Queens but only 6 points for Queens around that are not double Queens around or 8 points for Kings around that are not double Kings, plus points for the value of each marriage, e.g. 2 points for non-trump marriages and 4 points for each trump marriage. For instance, double Kings with a round house and a run is computed as 80 plus 6 for the Queens plus 6 for the marriages plus 15 for the run, equaling 107 melt points; not 80 plus 35 or 60 plus 35 in the case of double Queens.

Calculation of a Round House: A round house equals 24 points computed as follows: 8 points for Kings, 6 points for Queens, 6 points for three non-trump marriages and 4 points for trump marriages, i.e. 8+6+6+4 equals 24 points.

Bidding

The player to the left of the dealer bids first. Bidding begins with a minimum bid of 50 and increases in increments of 5 up to the posted winning score of either 250 or 500 points, as established at the beginning of the game. A player who does not choose to bid may simply say "pass." If no bid is tabled, that is, if the other two player elect to pass, the presumed dealer (as determined by the house if mechanical dealing is used) obtains the kitty cards through a default bid of 50. Otherwise, bidding continues until a player wins the bid (i.e. bids the highest). The highest bidder owns the kitty cards, has the right to name a trump and to lead playing of the hand. The highest bid is to be immediately posted to the score sheet, presumably managed by the house, to discourage players from contesting the bid as the game progresses.

Claiming Melt;

Upon winning the bid, the high bidder selects and declares a trump suit. The first marriage tabled by the high bidder is automatically trumps, to avoid attempt to change trumps after other players declare their melt. Conversely, if the high bidder does not have a marriage, i.e. a King and Queen of the same suit, to name trumps in or has insufficient melt points, i.e. less than 20, the hand can not be played. Also, the bidder is automatically set for the full amount of the bid, resulting in a reduction in his/her score equal to the amount of the bid. For example, if the highest or winning bid is 60 and melt is 35, and the bidder captures 24 of the 50 available points for a total score of 59, 1 point less than what is required to make the bid. The bidder is set for 60, the value of the bid. A player who has been set and has a negative score is limited in future bidding to the negative difference between the score and 250 or 500, as appropriate. For example, a player with a score of minus −105 can only bid up to 145 on subsequent bidding. A player with a score of minus −201 or more cannot table a bid until the negative score is less than minus −200 or −450, as appropriate.

After a trump has been named, players lay their melt face up on the gaming table to be tallied to their score, by the house or person designated as score keeper. When the highest bidder can not name a trump, i.e. does not having a marriage in any suit, no melt can be tallied as the hand can not be played without a trump suit. Otherwise, players may tally their respective melt to their score, provided it totals to at least 20 points. Players, other than the high bidder, need only capture 10 points through the playing of the hand to have the melt tallied to their accumulative score, the high bidder must capture a minimum of 20 points. If a player, other than high bidder, fails to capture a minimum of 10 points through play of the hand, their melt is forfeited, i.e. not tallied to their respective score. In every instance, the highest bid must be immediately posted to the score sheet to discourage players from contesting the bid as the game progresses. Sample hand tally score sheets are provided in FIGS. 4A & B; may be further modified by the house.

Playing the Hand

The player who won the bid begins the play by playing a card of choice leading to the first trick or book, and the remaining players play in turn. A trick/book consists of one card from each player and is won by the highest card played of the suit led. If any trumps are played to the trick, then the highest trump wins, regardless of any other cards in the trick. If there are two or more identical cards in a trick, the first of these cards played beats the others. The winner of a trick may play any card in leading to the next trick. Each subsequent player must follow suit and best the card played if they can, or play a trump even if they can't beat a trump already played to the trick or if they do not have a trump, play whatever off suit card in their hand.

Reneges: A renege occurs whenever a player fails to beat the highest card played to the trick despite having a higher ranked card or a trump card. When a suit is called, the nest player must play that suit if he/she has a card in that suit or a trump. For example, if an Ace is played and either of the next two players "only" has an Ace of the same suit, the Ace must be played and forfeited to the player of the first Ace or the suit must be trumped. The same applies where a first Ten, King, Queen of Jack is played, and the other players do not have a higher card in that suit or a trump. Thus the first Ten, King, Queen or Jack played wins the trick. A player guilty of a renege forfeits his/her melt and captured points for the hand. The player, therefore, is deemed to have failed to capture the minimum 10 points to tally melt tabled at the outset of the hand. A player who has no card of the suit led and no trumps may play any other card in their hand.

Failure of the house or other players to substantiate a renege requires that subsequent incidents of suspected improper trumping, cutting by playing other than the suit called or failure to best a card by a player having the ability to do so must be called and the trick held separate "hold location in FIG. 2" from other tricks until the end of the game. If this appears to be a continuing problem, such tricks should be identified ("hold" is the appropriate call) and held separately for the entire game; for possible ruling by house surveillance equipment, if available, and/or disqualification of the player for that game as determined by the house.

Failure of the highest bidder to replace the five kitty cards from "un-melted" cards before picking up his/her melt becomes a renege once the first trick is turned. The renege can not be called until after the first trick is turned, however, since the player might correct the renege before the first trick is actually turned. The renege may also be called at the end of the game when a player(s) discovers that the highest bidder still has un-played cards. As a penalty, the bidder captures 0 points for the hand and his/her score is reduced by the value of the bid. To discourage dishonesty, a renege also is deemed to occur when a player is caught peeping the kitty. In such instances, the player captures 0 points for the hand the hand may still be played.

When a player claims melt that he/she does not have, disclosed upon inspection of the player's actual melt by the house or one of the other players; thereby establishing the claimant does not have the requisite two same suit cards, his/her score is automatically reduced by the amount of the bid. For example, if a player falsely claims that he/she has double Aces, Kings, Queens or Jacks, the player may play the hand only if the actual melt is sufficient i.e. within 50 points of the bid to mathematically qualify for the playing of the hand. Nevertheless, the player's score is automatically reduced by the amount of the bid. If it is mathematically feasible for the bidder to play the hand, the hand must be played, to ensure the other players are not denied an opportunity to save their melt.

Winning a Four Game Set

The first player in each three person group that attains a score of 250 or 500, as appropriate, in two of the game's four game sets is the winner. In contest having nine or more players, the two game winners within each three person group become finalists and are identified as such on the contest finalist/leader board. For example, in fifty-four person contests involving nine gaming tables each table accommodating six players, as depicted herein, eighteen finalists emerge after the first maximum four game set of play is completed. These individuals (18), identified of the contest finalist/leader board, converge at three gaming tables to be seated as directed by the casino, the finalist/leader board of this invention is depicted at FIG. 3.

The finalists play a second four game set, according to the method described herein, so that six winners emerge from the finalist round of play. The six winners are identified on the finalist board by name or registration number and collect prize winnings based on total points tallied for their two winning games.

If the Three Hand Pinochle game of the present invention is played by thirty-six players, six gaming tables are utilized. Twelve winners of the first round of play become finalists. After the finalist round of play, four players, having won 2 games, share in the prize winnings, as qualified by the house at the beginning of the contest.

If the Three Hand Pinochle game of the present invention is played by eighteen players three gaming tables are utilized. Six winners of the first round of play become finalists. After the finalist round of play, two players, having won 2 games, share the prize winnings, as qualified by the house at the beginning of the contest.

If the game according to the present invention is played by nine players two gaming tables are utilized. Three winners of the first round of play become finalists. After the finalist round of play, one player claims the prize winnings. In this fashion, the present invention provides excitement to players of the game and a profit incentive for licensed casinos to make the game available to players of all skill levels.

Table Wagers

The cost of competing in the Three Hand Pinochle game is at least $50.00 per seat up to the house established ceiling (possibly $1,000,000). Players must wager on melt combinations "before" they receive their initial 25 cards and can collect on successful wagers immediately after a trump has been named, but before the high bidder starts the play of the hand. To collect the wager, after a trump has been named, a player needs only to display the successfully wagered melt.

For example, before receiving their initial twenty-five card hand, players may wager that they will be dealt a double run or double Aces, Kings, Queens or Jacks around as well as wager on being dealt double or triple pinochle within the initial twenty-five cards dealt. Players collect on successful wagers immediately after the five kitty cards are awarded to the high bidder and a trump has been named. The five kitty cards will only benefit melting possibilities of the high bidder but he must name his/her trump before the other players expose the melt in their hands or collect successful wagers. After the kitty cards are awarded and a trump named, only then can a high bidder collect on his/her successful wagers and does so by displaying melt from the 25 cards remaining after he/she places the five replacement kitty cards in his card stack. The high bidder, of course, has the wagering advantage gained from being able to utilize an initial thirty card hand to build melt combinations from.

Payouts on table wagers in this invention: payout odds are statistically based to ensure a minimum 75% return on wagers, derived from the analysis of 162 hands of play shown in this invention under "Summary of Actual and Theoretical Statistics.

Strength of hands: Double Aces and double runs are the hands with the highest strength expectations of each player, under this invention, as these hands have high melt and high trick pulling probabilities i.e. eight or more aces or at least ten trumps. But, under this invention, players having other high melt combinations, i.e. Triple Pinochle or double Queens or Jacks around, at the outset of a hand, is also a strong bidding inducement. Players with high melt, under this invention, tend to consistently table highly challenging bids, [80 and above] to name a trump of choice or prevent award of the coveted kitty to another player, thus possibly deny others a double run or double aces around. One's hand at the outset having comparatively lower trick pulling strength does not change the requirement for a minimum of 20 points to save a bid, attainable by a skilled player.

CASINO SCHEDULE OF PAYOUT FOR THREE HAND PINOCHLE
House Minimum per each two hour session of play 1. Payout schedule: $50 per seat, 54, 36, 18 or 9 players, (Does not include wagers)

| Pot total 54 at $50 | Pot total 36 at $50 | Pot total 18 at $50 | Pot total 9 at $50 | House Minimum $ | Each Contest Winner Splits |
|---|---|---|---|---|---|
| $2,700.00 | | | | $200.00 | $2,500 (6) |
| | $1,800.00 | | | $150.00 | $1,650 (4) |
| | | $900.00 | | $100.00 | $800 (2) |
| | | | $450.00 | $ 50.00 | $400 (1) |

2. Payout schedule: $100 per seat, 54, 36, 18 or 9 players, (Does not include wagers)

| Pot total 54 at $100 | Pot total 36 at $100 | Pot total 18 at $100 | Pot total 9 at 100 | House Minimum | Each Contest Winner Splits |
|---|---|---|---|---|---|
| $5,400.00 | | | | $400.00 | $,5000 (6) |
| | $3,600.00 | | | $300.00 | $3,300 (4) |
| | | $1,800.00 | | $200.00 | $1,600 (2) |
| | | | $900.00 | $100.00 | $800 (1) |

3. Payout schedule: $150 per seat, 54, 36, 18 or 9 players, (Does not include wagers)

| Pot total 54 at $150 | Pot total 36 at $150 | Pot total 18 at $150 | Pot total 9 at $150 | House Minimum | Each Contest Winner Splits |
|---|---|---|---|---|---|
| $8,100.00 | | | | $600.00 | $7,500 (6) |
| | $5,400.00 | | | $450.00 | $4,950 (4) |
| | | $2,700 | | $300.00 | $2,400 (2) |
| | | | $1,350.00 | $150.00 | $1,200 (1) |

4. Payout schedule: $200 per seat, 54, 36, 18 or 9 players, (Does not include wagers)

| Pot total 54 at $200 | Pot total 36 at $200 | Pot total 18 at $200 | Pot total 9 at $ 200 | House Minimum | Each Contest Winner Splits |
|---|---|---|---|---|---|
| $10,800.00 | | | | $800.00 | $10,000 (6) |
| | $7,200.00 | | | $600.00 | $6,600 (4) |
| | | $3,600.00 | | $400.00 | $3,200 (2) |
| | | | $1,800.00 | $200.00 | $1,600 (1) |

-continued

CASINO SCHEDULE OF PAYOUT FOR THREE HAND PINOCHLE
House Minimum per each two hour session of play 5. Payout schedule: $250 per seat, 54, 36, 18 or 9 players, (Does not include wagers)

| Pot total 54 at $250 | Pot total 36 at $250 | Pot total 18 at $250 | Pot total 9 at $250 | House Minimum | Each Contest Winner Splits |
|---|---|---|---|---|---|
| $13,500.00 | | | | $1,000.00 | $12,500 (6) |
| | $9,000 | | | $ 750.00 | $8,250 (4) |
| | | $4,500 | | $ 500.00 | $4,000 (2) |
| | | | $2,250 | $ 250.00 | $2,000 (1) |

6. Payout schedule: $300 per seat, 54, 36, 18 or 9 players, (Does not include wagers)

| Pot total 54 at $300 | Pot total 36 at $300 | Pot total 18 at $300 | Pot total 9 at $300 | House Minimum | Each Contest Winner Splits |
|---|---|---|---|---|---|
| $16,200.00 | | | | $1,200.00 | $15,000 (6) |
| | $10,800.00 | | | $ 900.00 | $9,900 (4) |
| | | $5,400.00 | | $ 600.00 | $4,800 (2) |
| | | | $2,700 | $ 300.00 | $2,400 (1) |

7. Payout schedule: $350 per seat, 54, 36, 18 or 9 players, (Does not include wagers)

| Pot total 54 at $350 | Pot total 36 at $350 | Pot total 18 at $350 | Pot total 9 at $350 | House Minimum | Each Contest Winner Splits |
|---|---|---|---|---|---|
| $18,900.00 | | | | $1,400.00 | $17,500 (6) |
| | $12,600.00 | | | $1,050.00 | $11,550 (4) |
| | | $6,300.00 | | $ 700.00 | $5,600 (2) |
| | | | $3,150.00 | $ 350.00 | $2,800 (1) |

8. Payout schedule: $400 per seat, 54, 36, 18 or 9 players, (Does not include wagers)

| Pot total 54 at $400 | Pot total 36 at $400 | Pot total 18 at $400 | Pot total 9 at $400 | House Minimum | Each Contest Winner Splits |
|---|---|---|---|---|---|
| $21,600.00 | | | | $1,600.00 | $20,000 (6) |
| | $14,400.00 | | | $1,200.00 | $13,200 (4) |
| | | $7,200.00 | | $ 800.00 | $6,400 (2) |
| | | | $3,600.00 | $ 400.00 | $2,200 (1) |

9. Payout schedule: $450 per seat, 54, 36, 18 or 9 players, (Does not include wagers)

| Pot total 54 at $450 | Pot total 36 at $450 | Pot total 18 at $450 | Pot total 9 at $450 | House Minimum | Each Contest Winner Splits |
|---|---|---|---|---|---|
| $24,300.00 | | | | $1,800.00 | $22,500 (6) |
| | $16,200.00 | | | $1,350.00 | $14,850 (4) |
| | | $8,100.00 | | $ 900.00 | $7,200 (2) |
| | | | $4,050.00 | $ 450.00 | $3,600 (1) |

10. Payout schedule: $500 per seat, 54, 36, 18 or 9 players, (Does not include wagers)

| Pot total 54 at $500 | Pot total 36 at $500 | Pot total 18 at $500 | Pot total 9 at $500 | House Minimum | Each Contest Winner Splits |
|---|---|---|---|---|---|
| $27,000.00 | | | | $2,000.00 | $25,000 (6) |
| | $18,000.00 | | | $1,500.00 | $16,500 (4) |
| | | $9,000.00 | | $1,000.00 | $8,000 (2) |
| | | | $4,500.00 | $ 500.00 | $4,000 (1) |

11. Payout schedule: $550 per seat, 54, 36, 18 or 9 players, (Does not include wagers)

| Pot total 54 at $550 | Pot total 36 at $550 | Pot total 18 at $550 | Pot total 9 at $550 | House Minimum | Each Contest Winner Splits |
|---|---|---|---|---|---|
| $29,700.00 | | | | $2,200.00 | $27,500 (6) |
| | $19,800.00 | | | $1,650.00 | $18,150 (4) |
| | | $9,900.00 | | $1,100.00 | $8,800 (2) |
| | | | $4,950.00 | $ 550.00 | $4,450 (1) |

12. Payout schedule: $600 per seat, 54, 36, 18 or 9 players, (Does not include wagers)

| Pot total 54 at $600 | Pot total 36 at $600 | Pot total 18 at $600 | Pot total 9 at $600 | House Minimum | Each Contest Winner Splits |
|---|---|---|---|---|---|
| $32,400.00 | | | | $2,400.00 | $30,000 (6) |

-continued

CASINO SCHEDULE OF PAYOUT FOR THREE HAND PINOCHLE
House Minimum per each two hour session of play

| | | | | | |
|---|---|---|---|---|---|
| | $21,600.00 | | | $ 1,800.00 | $19,800 (4) |
| | | $10,800.00 | | $ 1,200.00 | $9,600 (2) |
| | | | $5,400.00 | $ 600.00 | $4,800 (1) |

13. Payout schedule: $700 per seat, 54, 36, 18 or 9 players, (Does not include wagers)

| Pot total 54 at $700 | Pot total 36 at $700 | Pot total 18 at $700 | Pot total 9 at $700 | House Minimum | Each Contest Winner Splits |
|---|---|---|---|---|---|
| $37,800.00 | | | | $ 2,800.00 | $35,000 (6) |
| | $25,200.00 | | | $ 2,100.00 | $23,100 (4) |
| | | $12,600.00 | | $ 1,400.00 | $11,200 (2) |
| | | | $6,300.00 | $ 700.00 | $5,600 (1) |

14. Payout schedule: $1,000 per seat, 54, 36, 18 or 9 players, (Does not include wagers)

| Pot total 54 at $1,000 | Pot total 36 at $1,000 | Pot total 18 at $1,000 | Pot total 9 at $1,000 | House Minimum | Each Contest Winner Splits |
|---|---|---|---|---|---|
| $54,000.00 | | | | $ 4,000.00 | $50,000 (6) |
| | $36,000.00 | | | $ 3,000.00 | $33,000 (4) |
| | | $18,000.00 | | $ 2,000.00 | $16,000 (2) |
| | | | $9,000.00 | $ 1,000.00 | $8,000 (1) |

15. Payout schedule: $2,000 per seat, 54, 36, 18 or 9 players, (Does not include wagers)

| Pot total 54 at $2,000 | Pot total 36 at $2,000 | Pot total 18 at $2,000 | Pot total 9 at $2,000 | House Minimum | Each Contest Winner Splits |
|---|---|---|---|---|---|
| $108,000.00 | | | | $ 8,000.00 | $100.000 (6) |
| | $72,000.00 | | | $ 6,000.00 | $66.000 (4) |
| | | $36,000.00 | | $ 4,000.00 | $32,000 (2) |
| | | | $18,000.00 | $ 2,000.00 | $16,000 (1) |

16. Payout schedule: $3,000 per seat, 54, 36, 18, or 9 players, (Does not include wagers)

| Pot total 54 at $3,000 | Pot total 36 at $3,000 | Pot total 18 at $3,000 | Pot total 9 at $3,000 | House Minimum | Each Contest Winner Splits |
|---|---|---|---|---|---|
| $162,000.00 | | | | $12,000.00 | $150,000 (6) |
| | $108,000.00 | | | $ 9,000.00 | $99,000 (4) |
| | | $54,000.00 | | $ 6,000.00 | $6,000 (2) |
| | | | $27,000.00 | $ 3,000.00 | $3,000 (1) |

17. Payout schedule: $5,000 per seat, 54, 36, 18 or 9 players, (Does not include wagers)

| Pot total 54 at $5,000 | Pot total 36 at $5,000 | Pot total 18 at $5,000 | Pot total 9 at $5,000 | House Minimum | Each Contest Winner Splits |
|---|---|---|---|---|---|
| $270,000.00 | | | | $20,000 | $250,000 (6) |
| | $180,000.00 | | | $15,000 | $165,000 (4) |
| | | $90,000.00 | | $10,000 | $80,000 (2) |
| | | | $45,000.00 | $ 5,000 | $40,000 (1) |

18. Payout schedule: $10,000 per seat, 54, 36, 18 or 9 players, (Does not include wagers)

| Pot total 54 at $10,000 | Pot total 36 at $10,000 | Pot total 18 at $10,000 | Pot total 9 at $10,000 | House Minimum | Each Contest Winner Splits |
|---|---|---|---|---|---|
| $540,000.00 | | | | $40,000 | $500,000 (6) |
| | $360,000.00 | | | $30,000 | $330,000 (4) |
| | | $180,000.00 | | $20,000 | $160,000 (2) |
| | | | $90,000 | $10,000 | $80,000 (1) |

Under this invention, while this payout schedule starts at $50,00 per seat for 54 seats and ends at $10,000 per seat for 54 seats, other larger or smaller payout combinations may be devised, as determined by the hosting casino consistent with regulatory guidelines. The winner's pot, for example, may be further augmented based on positive profit elements directly related to the game: wagers; food; lodging etc., to increase the overall attractiveness of the game to perspective players.

Statistical Evaluation of Theoretical Percentages

Under this invention, schedules of statistical odds reflect the basis for projections by casinos to secure reasonable profit based on a minimum 75% return on wagers to the wage maker. The statistics are based on 162 hands of Three Hand Pinochle dealt to three players. The schedules are organized into three 54 hand segments, to reflect melt points under "Melt Before Kitty" for melt contained within the initial 25 cards dealt to each player. The schedules' "Melt If High Bidder" columns indicate theoretical melt results for the different combinations of melt listed under the "5 kitty cards columns. The column "Pinochies Triple/P Double/P" reflect double and triple pinochle events within 25 cards, in brackets, and within 30 cards, no brackets. Melt values are calculated on the assumption that each of the players is ultimate highest bidder. In practice, however, only one member of each three player group can be the highest bidder and thus receive the five coveted kitty cards from which to tally additional melt. Wagers on Double Runs, Aces, Kings, Queens and Jacks apply to the brackets under the "Doubles" column, as they occurred within the initial 25 cards dealt.

The purpose of the first six schedules is to show the "Maximum Melt Potential" from the perspective of each of the three players, assuming high bidder status. Following the six schedules are decremented schedules showing the separate melt results for each player (1) (2) and (3) considering (brackets) only the first 25 cards so as to isolate under the last page a recap of double/triple results impacting wagers. The "Doubles" column reflect instances where a player, among his/her 25 or 30 cards, has double Jacks, Queens, Kings, Aces, or a double run to tally into their melt.

As stated, the decremented schedules exclude melt derived from the five kitty cards by other than one high bidder. The same logic applies to the heading "Pinochles: Triple/P; Double/P—the values gained from the 5 card kitty is removed from two players but retained for the presumed high bidder. Exceptions are noted, to reflect instances where double and triple pinochles were dealt in the first 25 cards from instances where double or triple pinochles occurred in 30 card—which can only apply to the high bidder. ABBREVIATIONS: The following abbreviations are employed herein:

Lower case letters: h=hearts, d=diamonds, s=spades, c=clubs and 10+lower case letter denotes a suit Upper case letters: A=ace, K=king, Qu and Q=queen, and J=Jacks. D-R, D-r and Dr=Double Run, D=double pinochle, T=triple pinochle; ( )=first 25 cards.

STATISTICAL EVALUATION OF THEORETICAL PERCENTAGES
THREE HAND PINOCHLE

| Hand | Doubles | | | Melt Before Kitty | | | | Melt If High Bidder | | | Pinochle Triple/P Double/p | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| 1 | | | | 23 | 48 | 14 | Ah/J, 2-Kc/Qs | 45 | 67 | 31 | | (D) | |
| 2 | | | | 33 | 17 | 12 | 2, 10d/2, Kd/Kc | 39 | 29 | 12 | | | |
| 3 | | aces | | 34 | 39 | 18 | Ac/A, 10, Js/Jh | 51 | 135 | 37 | D | | |
| 4 | Aces | kings | | 39 | 31 | 35 | A, 10, Qc/Ks/Jh | 129 | 111 | 35 | | | |
| 5 | | | | 25 | 39 | 25 | A, 10, Jh/Ks/Qd | 31 | 39 | 31 | | | |
| 6 | | | D-r | 25 | 75 | 43 | 10, K, Qc/Qd/Jh | 47 | 77 | 178 | | (D) | |
| 7 | | | (kings) | 4 | 61 | 101 | K, 10d/Ah/Ks/10c | 35 | 65 | 101 | | D | |
| 8 | | | | 24 | 31 | 12 | 10, K, Jh/K, Qs | 41 | 63 | 14 | | D | |
| 9 | | | | 33 | 52 | 43 | Ad/10, Qc/Kh/Ks | 39 | 73 | 43 | | (D) | |
| 10 | D-r | | | 31 | 39 | 25 | A, 10s/Ac/10, Qd | 166 | 39 | 25 | | | |
| 11 | | | | 27 | 41 | 19 | 10, 2K, Qd/Jh | 29 | 47 | 35 | | | |
| 12 | | (kings) | | 39 | 107 | 19 | A, Jh/Kd/2Qs | 39 | 117 | 69 | | | D |
| 13 | | | King | 34 | 25 | 18 | A, Kc/K, Qh/Kd | 59 | 35 | 106 | D | | |
| 14 | Jacks | | D-r | 25 | 20 | 31 | K, Js/10h/Jd/Jc | 57 | 41 | 166 | | | |
| 15 | | | | 8 | 23 | 34 | Q, 10d/2-10h/10s | 23 | 27 | 45 | | | |
| 16 | | Kings | | 26 | 31 | 53 | Ah/2-K, Qc/Ks | 30 | 113 | 77 | | | (D) |
| 17 | | (jacks) | | 61 | 55 | 16 | A, Ks/A, Jh/Jc | 63 | 97 | 27 | (D) | (D) | |
| 18 | | | | 12 | 61 | 41 | 10, Kd/10, Kc/Ks | 37 | 69 | 41 | | (D) | |
| 19 | | | | 12 | 22 | 61 | A, Js/Kc/10h/Jd | 25 | 35 | 61 | | | (D) |
| 20 | | | | 115 | 41 | 35 | A, Qc/K, Jh/Js | 115 | 43 | 35 | (T) | | |
| 21 | | | | 39 | 29 | 43 | A, Jc/10, Qs/Qd | 65 | 45 | 51 | D | | |
| 22 | | | | 33 | 12 | 10 | A, 10, Kc/Ks/Qh | 33 | 35 | 28 | | | |
| 23 | | | | 17 | 27 | 16 | A, K, Qc/A, Jd | 29 | 43 | 33 | | | |
| 24 | | | Jacks | 39 | 31 | 33 | 2-Q, Jc/Js/Jh | 39 | 39 | 71 | | | |
| 25 | | | | 25 | 25 | 27 | Ah/K, Q, Jd/Ks | 43 | 33 | 27 | | | |
| 26 | | Jacks | | 59 | 19 | 16 | 10, 2Q, Jd/Ks | 133 | 63 | 24 | T | | |
| 27 | | | | 34 | 33 | 2 | Ah/K, QJc/10d | 53 | 35 | 33 | | | |
| 28 | | | | 17 | 31 | 61 | A, K, Jh/2Qd | 29 | 33 | 61 | | | (D) |
| 29 | | | | 26 | 35 | 29 | A, 10, K, Qc/Ah | 37 | 49 | 45 | | | |
| 30 | | | (D-r) | 29 | 23 | 152 | 10, Kd/10, Qc/Qh | 31 | 31 | 170 | | | |

After 30 Hands: ( ) indicate doubles in 25 cards 30 hands: 4/ in 30 cards: 11 (presumes 1, 2 & 3 were High Bidders)
25 card doubles: Jacks: 1/ Queens: 0/ Kings: 2/ Aces: 0/ Double Runs: 1/
Double Pinochle: 25 cards 9/30/; in 30 cards 6/30/ Total = 15
Triple Pinochle in 25 cards: 1/30/; Triple Pinochle in 30 cards: 1/30/ Total = 2
Note:
In practice, only one bidder receives 5 kitty cards to tally additional melt.

| | | | | | | | | | | | | | |
|---|---|---|---|---|---|---|---|---|---|---|---|---|---|
| 31 | | | | 29 | 35 | 33 | A, 10d/2-Qc/Kh | 43 | 41 | 35 | | | |
| 32 | Dr | kings | | 17 | 61 | 19 | A, K, Jc/Ks/Kd | 162 | 137 | 21 | | (D) | |
| 33 | | | | 23 | 35 | 46 | 2-A, 10c/K, Qs | 35 | 67 | 52 | | D | (D) |
| 34 | | | | 35 | 25 | 51 | A, Ks/Kc/Kd/Qh | 47 | 41 | 61 | | | (D) |
| 35 | | | | 22 | 37 | 55 | 10, 2-Js/10d/Qh | 41 | 37 | 63 | | | (D) |
| 36 | (Jacks) | | | 50 | 24 | 20 | Ah/10, Qc/K, Jd | 65 | 41 | 50 | | | D |
| 37 | Dr | | Qu | 37 | 27 | 57 | As/10, Qc/Q, Jd | 170 | 43 | 171 | | | (D)T |
| 38 | Dr | | | 21 | 31 | 29 | 2-10, Qh/Jc/Js | 156 | 33 | 35 | | | |

-continued

STATISTICAL EVALUATION OF THEORETICAL PERCENTAGES
THREE HAND PINOCHLE

| Hand | Doubles | | | Melt Before Kitty | | | | Melt If High Bidder | | | Pinochle Triple/P Double/p | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| 39 | | | | 43 | 36 | 19 | A, Q, Jc/K, Jd | 73 | 71 | 33 | D | D | |
| 40 | | | (Qu) | 23 | 25 | 113 | 2-10, Qd/Kh/Qc | 25 | 29 | 125 | | | (D) |
| 41 | | | | 37 | 43 | 35 | A, K, Qs/10c/Kh | 41 | 76 | 61 | | D | (D) |
| 42 | Qu | | | 29 | 25 | 18 | A, Q, Js/2-Qc | 83 | 53 | 33 | | | |
| 43 | | (aces) | | 31 | 116 | 35 | 10, 2-Qc/2-10h | 31 | 118 | 49 | | | |
| 44 | | | | 107 | 23 | 43 | A, 10h/10c/Ks/Qd | 109 | 35 | 53 | (T) | | |
| 45 | Qu | Dr | | 27 | 33 | 19 | Ah/2Qs/Qd/Jc | 83 | 166 | 65 | | | D |
| 46 | | | | 17 | 25 | 6 | 2Q, Js/Qd/Jh | 23 | 49 | 51 | | D | D |
| 47 | | | | 8 | 29 | 27 | A, 2-10, Kd/Ac | 29 | 33 | 27 | | | |
| 48 | | (aces) | | 39 | 104 | 33 | K, 2-Qs/10d/Jh | 71 | 117 | 67 | D | | D |
| 49 | | | | 26 | 20 | 4 | A, Kc/Ks/Kd/Qh | 33 | 37 | 14 | | | |
| 50 | | | | 23 | 31 | 10 | Ad/K, 10c/2-Qh | 39 | 31 | 18 | | | |
| 51 | Aces | | | 31 | 31 | 57 | A, 10, Ks/Ah/Ac | 133 | 41 | 57 | | | |
| 52 | | | | 29 | 35 | 6 | A, Q, Jd/Kh/Ks | 31 | 43 | 41 | | | |
| 53 | | | | 35 | 112 | 14 | A, 10s/2-Kh/Ks | 37 | 133 | 29 | | (T) | |
| 54 | | | | 23 | 12 | 27 | 10d/Ks/Q, Jh/Qc | 25 | 29 | 27 | | | |

After 54 Hands: ( ) doubles in 25 cards 54 hands: 4 + 4 = 8/
total in 30 cards: 11 + 9 = 20 (presumes 1, 2 & 3 were High Bidders)
25 card doubles: Jacks: 2/ Queens: 1/ Kings: 2/ Aces: 2/ Double Runs: 1/.
Double Pinochle in 25 Cards: 9 + 7 = 16/; in 30 Cards: 9 + 10 = 19/.
Triple Pinochle in 25 Cards: 3/54/ Triple Pinochle in 30 Cards: 2/54/ Total 54 hands: 5/
In practice, only one high bidder receives kitty cards to tally additional melt.

Start of second 54 hand evaluation:

| | | | | | | | | | | | | | |
|---|---|---|---|---|---|---|---|---|---|---|---|---|---|
| 1 | | D-R | | 75 | 29 | 29 | A, Q, Jd/10c/Qs | 135 | 180 | 47 | (D)T | | |
| 2 | | (Jacks) | | 49 | 52 | 33 | 2-A, 10c/10, Js | 49 | 67 | 33 | | | |
| 3 | | | | 21 | 8 | 40 | A, Kd/Ah/Kc/Qs | 29 | 22 | 119 | | | (D)T |
| 4 | | | | 31 | 41 | 22 | A, 10, Q, Jc/Qd | 31 | 45 | 35 | | | |
| 5 | | | | 25 | 16 | 29 | A, 2-Q, 2-10c | 31 | 27 | 33 | | | |
| 6 | | | | 31 | 12 | 41 | A, 10d/As/10, Qc | 45 | 33 | 41 | | | |
| 7 | D-R | | | 37 | 31 | 61 | A, K, Qh/10d/Jc | 172 | 33 | 71 | | | (D) |
| 8 | A + K | | | 22 | 17 | 10 | A, 2-Kc/Ad/Qs | 196 | 39 | 35 | | | |
| 9 | | | Jacks | 28 | 35 | 32 | 10, Q, 2-Jh/Kd | 37 | 39 | 93 | | | D |
| 10 | | | | 4 | 43 | 44 | 2-Ah/A, 10s/Ac | 25 | 43 | 63 | | | |
| 11 | | | | 53 | 31 | 57 | A, 10d/As/K, Qh | 55 | 35 | 69 | | | (D) |
| 12 | Queen | | | 28 | 27 | 31 | A, 10s/K, Qd/Qh | 84 | 33 | 37 | | | |
| 13 | | | D-R | 31 | 29 | 23 | 2-Ah/2-10c/10d | 31 | 29 | 156 | | | |
| 14 | | | | 16 | 16 | 10 | Ad/10, Kc/10, Js | 29 | 27 | 14 | | | |
| 15 | | | | 39 | 37 | 33 | A, Kh/2-Jc/Ks | 39 | 53 | 41 | | | |
| 16 | | D-R | | 29 | 29 | 30 | As/2-Kc/Kh/10d | 33 | 172 | 30 | | | |
| 17 | | | | 31 | 29 | 12 | 2-As/2-10, Qc | 31 | 47 | 12 | | | |
| 18 | Queen | D-R | | 22 | 22 | 10 | Ac/2-10, Qd/10h | 76 | 164 | 14 | | | |
| 19 | Jacks | | Jacks | 18 | 22 | 29 | 2-Q, 2-Js/Jc | 89 | 37 | 97 | D | | D |
| 20 | | | D-R | 39 | 0 | 41 | A, Kc/K, Jd/Kh | 65 | 17 | 168 | (D) | | |
| 21 | | | aces | 35 | 46 | 31 | A, 2-10, Ks/Kc | 35 | 73 | 131 | | (D) | |
| 22 | (Aces) | | | 121 | 8 | 14 | 2-A, 2Kh/As | 221 | 33 | 35 | (T) | | |
| 23 | (D-R) | (D-R) | | 160 | 160 | 25 | 10h/K, Qs/10, Jc | 162 | 162 | 31 | | | |
| 24 | | | | 29 | 27 | 49 | A, Jc/10h/Qd/Js | 31 | 27 | 53 | | | (D) |
| 25 | Jacks | | D-R | 33 | 35 | 23 | A, Jh/Qd/10c/Js | 67 | 37 | 162 | | | |
| 26 | | | | 35 | 40 | 19 | 2-K, Js/10c/Qd | 37 | 55 | 27 | | (D) | |
| 27 | | | | 35 | 25 | 69 | Q, 2-Jh/Jd/Js | 61 | 29 | 81 | D | | (D) |
| 28 | | | | 10 | 90 | 28 | Ah/2-10, Kd/Ks | 14 | 107 | 38 | | (T) | |
| 29 | | | | 35 | 29 | 51 | As/10, Qd/K, Jh | 35 | 31 | 69 | | | (D) |
| 30 | Queen | (Kings) | | 33 | 96 | 17 | 3-A.10h/Qd | 95 | 115 | 27 | | | |

After 30 Hands: ( ) indicate doubles in 25 cards: 5/ Total in 30 Cards: 16/ (presumes 1, 2, & 3 were high Bidders)
25 card doubles: Jacks: 1/ Queens: 0/ Kings: 1/ Aces: 1/ Double Runs: 2/
Double Pinochle: 25 cards 10/ Double Pinochle in 30 cards: 4/ total = 14
Triple Pinochle in 25 cards: 2/ Triple Pinochle in 30 Cards: 2/ total = 4
Note:
In practice, only high bidder receives 5 kitty cards to tally additional melt.

| | | | | | | | | | | | | | |
|---|---|---|---|---|---|---|---|---|---|---|---|---|---|
| 31 | | | | 31 | 21 | 33 | K, Jd/2-10s/10c | 33 | 25 | 39 | | | |
| 32 | | | | 45 | 18 | 25 | 2-A, Qd/Kh/Kc | 47 | 35 | 53 | | | |
| 33 | | Queens | (Jacks) | 67 | 29 | 67 | Ad/K, Qh/Qs/Jc | 69 | 91 | 93 | (D) | | |
| 34 | | D-r | | 33 | 43 | 14 | A, 10, Kc/Q, Ks | 43 | 174 | 37 | | | |
| 35 | | | Aces | 29 | 29 | 41 | A, Jd/Q, Jh/Jc | 53 | 33 | 159 | | | D |
| 36 | | | | 32 | 29 | 69 | A, Qs/Q, Jh/10c | 47 | 31 | 69 | | | (D) |
| 37 | | | Queen | 18 | 6 | 27 | 2-A, Qs/Kd/Qc | 22 | 47 | 87 | | | |
| 38 | D-r | Jacks | | 23 | 29 | 37 | Q, 3-Jh/Qs | 154 | 93 | 47 | | D | |
| 39 | (Kings) | | Aces | 109 | 31 | 25 | Ah/A, Js/2-Qc | 117 | 31 | 115 | | | |
| 40 | Qu | Queens | D-r | 47 | 41 | 27 | K, Jc/Q, Js/Qd | 127 | 99 | 160 | (D) | | |

-continued

STATISTICAL EVALUATION OF THEORETICAL PERCENTAGES
THREE HAND PINOCHLE

| Hand | Doubles | | | Melt Before Kitty | | | | Melt If High Bidder | | | Pinochle Triple/P Double/p | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| 41 | | | | 22 | 43 | 4 | 10, K, Qh/Kd/Qc | 43 | 55 | 29 | | | |
| 42 | | | | 28 | 25 | 25 | 10, K, 2-Q, Js | 73 | 35 | 75 | D | D | |
| 43 | | | (Qu) | 17 | 27 | 108 | 10, 2-K, Qh/Qc | 23 | 39 | 112 | | | (D) |
| 44 | | | | 29 | 43 | 14 | 2-K, Qd/Q, Jc | 37 | 45 | 31 | | | |
| 45 | Jacks | (Aces) | Aces | 22 | 100 | 14 | A, K, h/2-Jd/Js | 99 | 100 | 151 | D | | D |
| 46 | (D-r) | | | 156 | 22 | 67 | As/2-Jh/Q, Jc | 156 | 38 | 71 | | | (D) |
| 47 | | | Aces | 27 | 53 | 39 | 2-A, 10c/As/Qh | 27 | 55 | 131 | | (D) | |
| 48 | | | | 27 | 35 | 27 | Q, 3-Jd/Jc | 33 | 125 | 31 | | T | |
| 49 | (D-r) | | | 164 | 25 | 35 | Ah/Ad/10, Qs/Qc | 168 | 39 | 35 | | | |
| 50 | Qu | (Jacks) | | 14 | 61 | 29 | 10, 2-Jc/10, Qs | 70 | 101 | 35 | | (D) | |
| 51 | | | Aces | 35 | 41 | 20 | Ac/Ad/As/10, Jh | 35 | 141 | 20 | | | |
| 52 | | | (Jacks) | 33 | 26 | 55 | 10c/10s/2-Qh/Jd | 37 | 41 | 55 | | | |
| 53 | | (D-r) | | 27 | 160 | 31 | 2-10h/Q, Js/Jc | 27 | 162 | 39 | | | |
| 54 | | | | 12 | 10 | 29 | Ad/K, Qh/Q, Jc | 35 | 14 | 31 | | | |

After 54 Hands: [108 hands into the evaluation]
( ) indicate doubles in 25 cards: 9/ in 30 cards: 15/ Total = 24 (assumes 1, 2 and 3 are were High Bidders)
25 card doubles in 54 hands: Jacks: 5/ Queens: 1/ Kings: 2/ Aces: 2/ Double Runs: 5/
Double Pinochle in 25 Cards: 17/; in 30 Cards: 10/ Total = 27.
Triple Pinochle in 25 Cards: 2/ Triple Pinochle in 30 Cards: 3/ Total in 54 hands: 5/
In practice, only High Bidder receives 5 kitty cards to tally additional melt.

Start of third 54 hand evaluation:

| | | | | | | | | | | | | | |
|---|---|---|---|---|---|---|---|---|---|---|---|---|---|
| 1 | | | Kings | 29 | 49 | 23 | A, Ks/10, Qc/Kh | 33 | 53 | 109 | | | |
| 2 | | | | 23 | 16 | 16 | Ac/Ah/10, Jd/Jc | 27 | 35 | 31 | | | |
| 3 | | | | 20 | 21 | 18 | A, 10, Qc/Ad/Ks | 26 | 33 | 33 | | | |
| 4 | | | | 31 | 35 | 31 | A, Q, Js/10c/Jd | 41 | 41 | 39 | | | |
| 5 | | | (A) + DR | 52 | 43 | 112 | Ad/2-10, Qc/Jh | 54 | 53 | 254 | (D) | | |
| 6 | | | (D-R) | 31 | 63 | 167 | K, 2-Jc/Q, Jh | 31 | 65 | 171 | | (D) | |
| 7 | | | | 22 | 14 | 33 | A, 3-Kd/10s | 47 | 25 | 37 | | | |
| 8 | | (D-R) | D-R | 58 | 158 | 20 | A, 2-10, Kh/Ks | 58 | 170 | 166 | (D) | | |
| 9 | | | | 29 | 18 | 25 | Ad/Q, Jh/10, Qc | 49 | 35 | 29 | | | |
| 10 | | | (Aces) | 33 | 45 | 125 | 10, Kd/10, Qh/Qs | 67 | 45 | 155 | D | | D |
| 11 | | | | 16 | 22 | 25 | A, 10, Jc/Ks/10d | 27 | 33 | 35 | | | |
| 12 | | | | 31 | 31 | 4 | 2-A, 10c/Ad/10h | 35 | 31 | 27 | | | |
| 13 | | Jacks | | 35 | 14 | 21 | 2-A, 10d/Qh/Jc | 35 | 65 | 37 | | | |
| 14 | | | | 27 | 22 | 25 | As/10, K, Qh/Kd | 33 | 37 | 53 | | | |
| 15 | | | | 19 | 30 | 37 | 10, 2-Qs/10d/Jh | 49 | 43 | 41 | D | | |
| 16 | | | | 4 | 37 | 31 | 2-As/Qd/Jh/Jc | 19 | 37 | 45 | | | |
| 17 | D-R | Jacks | | 31 | 35 | 33 | 10, K, 2-Q, Jh | 168 | 83 | 35 | | | |
| 18 | | | | 35 | 29 | 31 | 2-A, 10c/10s/Jd | 61 | 29 | 41 | D | | |
| 19 | | | | 35 | 27 | 25 | 2-Ac/As, 10, Kd | 43 | 31 | 35 | | | |
| 20 | Kings | | | 45 | 27 | 28 | 10, Js/10, Kh/Kc | 117 | 47 | 30 | | | |
| 21 | | (Jacks) | Kings | 14 | 54 | 30 | 10, Kd/10, Js/Qc | 33 | 56 | 103 | | | |
| 22 | | | | 10 | 31 | 37 | 10, Qc/Kh/Q, Js | 34 | 57 | 41 | | D | |
| 23 | | | | 46 | 29 | 19 | 3-Q, Jh/Ks | 65 | 33 | 25 | (D) | | |
| 24 | (D-R) | Aces | | 166 | 31 | 31 | Ac/Ah/A, Qs/Kd | 188 | 121 | 43 | | | |
| 25 | | | | 25 | 19 | 75 | Kc/K, Qh/K, Qs | 47 | 29 | 79 | | | D |
| 26 | | | | 37 | 53 | 27 | A, 10, Qc/10h/Kd | 43 | 53 | 31 | | (D) | |
| 27 | | | D-R | 23 | 10 | 57 | A, 2-Ks/Ac/10h | 31 | 18 | 192 | | | (D) |
| 28 | (Jacks) | | | 65 | 22 | 43 | A, 10c/10, K, Jd | 75 | 45 | 43 | | | |
| 29 | | (Queens) | | 43 | 93 | 10 | A, Qd/10, K, Js | 53 | 97 | 31 | | | |
| 30 | Aces | (D-R) | | 10 | 152 | 31 | A, Q, Js/Kh/Qd | 115 | 156 | 63 | | | D |

After 30 Hands [138 hands into the evaluation]
( ) indicate doubles in 25 cards: 9/. Total in 30 cards: 11/ (presumes 1, 2, & 3 were High Bidders)
25 card doubles: Jacks: 2/ Queens: 1/ Kings: 0/ Aces: 2/ Double Runs: 4/
Double Pinochle 25 Cards: 6/ Double Pinochle in 30 Cards 7/ Total = 13/
Triple Pinochle in 25 Cards: 0/ Triple Pinochle in 30 Cards: 0/ Total = 0/
In practice, only one bidder receives 5 kitty cards to tally additional melt.

| | | | | | | | | | | | | | |
|---|---|---|---|---|---|---|---|---|---|---|---|---|---|
| 31 | | | | 4 | 35 | 14 | Kh/K, Qc/Jd/Js | 21 | 41 | 71 | | | D |
| 32 | | | | 23 | 41 | 18 | A, 10h/K, Qs/10c | 37 | 45 | 31 | | | |
| 33 | Kings | | | 27 | 47 | 8 | Ad/10, Ks/Qc/Kh | 100 | 53 | 10 | | (D) | |
| 34 | | (Jacks) | | 29 | 63 | 21 | 2-K, 10h/10, Jd | 29 | 65 | 29 | | | |
| 35 | | D-R | | 37 | 25 | 39 | 2-A, 10c/Ad/Js | 37 | 166 | 47 | | | |
| 36 | | Queens | | 8 | 35 | 35 | A, 10, Qs/10, Qc | 25 | 99 | 43 | | | |
| 37 | | | (Jacks) | 45 | 18 | 87 | Ad/K, 2-Jh/Qc | 47 | 33 | 105 | | | (D) |
| 38 | (kings) | | | 96 | 18 | 34 | A, 10, Kc/10h/Kd | 100 | 35 | 67 | | | D |
| 39 | | | | 59 | 33 | 39 | A, 10c/10, 2-Ks | 63 | 43 | 41 | (D) | | |
| 40 | D-R | | (D-R) | 55 | 19 | 164 | A, 10, Jh/K, Qc | 192 | 33 | 176 | (D) | | |
| 41 | | | | 51 | 23 | 23 | A, 2-10s/K, Qh | 63 | 25 | 25 | (D) | | |
| 42 | (Jacks) | D-R | kings | 78 | 29 | 18 | K, Q, Jc/Kh/Jd | 93 | 174 | 96 | (D) | | |

-continued

STATISTICAL EVALUATION OF THEORETICAL PERCENTAGES
THREE HAND PINOCHLE

| Hand | Doubles | | | Melt Before Kitty | | | | Melt If High Bidder | | | Pinochle Triple/P Double/p | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| 43 | | | | 35 | 15 | 19 | 2-Q, Js/Qc/Qd | 127 | 27 | 24 | T | | |
| 44 | | | | 43 | 35 | 31 | 2-A, 10h/2-10c | 43 | 35 | 31 | | | |
| 45 | | Aces | | 23 | 21 | 55 | Ad/2-A, Kc/Js | 23 | 123 | 55 | | | |
| 46 | | (Kings) | | 35 | 94 | 42 | A, 10, Qd/2-Qh | 37 | 100 | 65 | | | (D) |
| 47 | | | | 39 | 6 | 16 | Ah/A, 10, Kd/10s | 39 | 19 | 31 | | | |
| 48 | | | D-R | 25 | 23 | 35 | A, 10, 2-Ks/Qd | 47 | 43 | 174 | | | |
| 49 | | Queens | | 59 | 31 | 29 | K, Qc/Kd/Q, Js | 69 | 89 | 43 | (D) | | |
| 50 | Aces | | | 29 | 27 | 29 | A, 10, Kd/10, Kc | 129 | 35 | 31 | | | |
| 51 | | | | 49 | 25 | 33 | A, 2-K, Qh/Ac | 53 | 39 | 53 | | | |
| 52 | | | D-R | 41 | 29 | 41 | Ad/3-Jc/Jh | 41 | 43 | 178 | | | |
| 53 | | (Queens) | | 27 | 87 | 31 | A, 10h/2-10s/Jd | 27 | 101 | 31 | | | |
| 54 | | | | 63 | 31 | 29 | 2-10h/Kc/Ks/Jd | 67 | 67 | 33 | (D) | D | |

After 54 Hands [end of the162 hand theoretical evaluation]
( ) indicate doubles in 25 cards 54 hands: 16/ (9 + 7)/.
Total in 30 cards 54 hands: 22/11 + 11) (presumes 1, 2, & 3 were High Bidders)
25 card doubles: Jacks: 5 (2 + 3)/ Queens: 2 (1 + 1)/ Kings: 2/ (0 + 2)/ Aces: 2/ (0 + 2)/
Double Runs: 5/ (4 + 1)/
Double Pinochle in 25 Cards: 9/ in 30 Cards: 3/
Total Double Pinochles (25 & 30 cards) in 54 hands: 25/.
Triple Pinochle in 25 Cards: 0/ Triple Pinochle in 30 Cards: 1/ Total in 54 hands: 1/.
In practice, only highest bidder receives 5 kitty cards to tally additional melt.
The data here reflect melt totals for all three as if each player were the high bidder.
Note:
for accuracy in evaluation of double projections, the next set of schedules
decrement the results to reflect only one high bidder.

STATISTICAL EVALUATION OF DOUBLE OCCURRENCES
ACTUAL MELT

| Hand | Doubles | | | Melt Before Kitty | | | | Bidder (1) is High Bidder (6 exceptions) | | | Pinochle Triple/P Double/P | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| Player (1) is highest bidder, exceptions are noted after 30 and 54 hands | | | | | | | | | | | | | |
| 1 | | | | 23 | 48 | 14 | Ah/J, 2-Kc/Qs | 45 | | | | (D) | |
| 2 | | | | 33 | 17 | 12 | 2, 10d/2, Kd/Kc | 39 | | | | | |
| 3 | | | | 34 | 39 | 18 | Ac/A, 10, Js/Jh | 51 | | | (D) | | |
| 4 | Aces | | | 39 | 31 | 35 | A, 10, Qc/Ks/Jh | 129 | | | | | |
| 5 | | | | 25 | 39 | 25 | A, 10, Jh/Ks/Qd | 31 | | | | | |
| 6 | | | | 25 | 75 | 43 | 10, K, Qc/Qd/Jh | 47 | | | | (D) | |
| 7 | | | (Kings) | 4 | 61 | 101 | K, 10d/Ah/Ks/10c | 35 | | 101 | | (D) | |
| 8 | | | | 24 | 31 | 12 | 10, K, Jh/K, Qs | 41 | | | | | |
| 9 | | | | 33 | 52 | 43 | Ad/10, Qc/Kh/Ks | 39 | | | | (D) | |
| 10 | D-r | | | 31 | 39 | 25 | A, 10s/Ac/10, Qd | 166 | | | | | |
| 11 | | | | 27 | 41 | 19 | 10, 2K, Qd/Jh | 29 | | | | | |
| 12 | | (kings) | | 39 | 107 | 19 | A, Jh/Kd/2Qs | 39 | 117 | | | | |
| 13 | | | | 34 | 25 | 18 | A, Kc/K, Qh/Kd | 59 | | | D | | |
| 14 | Jacks | | | 25 | 20 | 31 | K, Js/10h/Jd/Jc | 57 | | | | | |
| 15 | | | | 8 | 23 | 34 | Q, 10d/2-10h/10s | 23 | | | | | |
| 16 | | | | 26 | 31 | 53 | Ah/2-K, Qc/Ks | 30 | | 77 | | | (D) |
| 17 | | | | 61 | 55 | 16 | A, Ks/A, Jh/Jc | 63 | | | (D) | (D) | |
| 18 | | | | 12 | 61 | 41 | 10, Kd/10, Kc/Ks | 37 | 69 | | | (D) | |
| 19 | | | | 12 | 22 | 61 | A, Js/Kc/10h/Jd | 25 | | | | | (D) |
| 20 | | | | 115 | 41 | 35 | A, Qc/K, Jh/Js | 115 | | | (T) | | |
| 21 | | | | 39 | 29 | 43 | A, Jc/10, Qs/Qd | 65 | | | D | | |
| 22 | | | | 33 | 12 | 10 | A, 10, Kc/Ks/Qh | 33 | | | | | |
| 23 | | | | 17 | 27 | 16 | A, K, Qc/A, Jd | 29 | | | | | |
| 24 | | | | 39 | 31 | 33 | 2-Q, Jc/Js/Th | 39 | | | | | |
| 25 | | | | 25 | 25 | 27 | Ah/K, Q, Jd/Ks | 43 | | | | | |
| 26 | | | | 59 | 19 | 16 | 10, 2Q, Jd/Ks | 133 | | | T | | |
| 27 | | | | 34 | 33 | 2 | Ah/K, QJc/10d | 53 | | | | | |
| 28 | | | | 17 | 31 | 61 | A, K, Jh/2Qd | 29 | | 61 | | | (D) |

-continued

STATISTICAL EVALUATION OF DOUBLE OCCURRENCES
ACTUAL MELT

| Hand | Doubles | | | Melt Before Kitty | | | | Bidder (1) is High Bidder (6 exceptions) | | | Pinochle Triple/P Double/P | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| 29 | | | | 26 | 35 | 29 | A, 10, K, Qc/Ah | 37 | | | | | |
| 30 | | | (D-r) | 29 | 23 | 152 | 10, Kd/10, Qc/Qh | 31 | | 170 | | | |

After 30 Hands: ( ) indicate doubles in 25 cards 30 hands: 3/10% In 30 Cards: 6/.
Consisting of: Double Jacks: 1/ Queens: 0/ Kings: 2/ Aces: 1/ Double Runs: 2/.
[(1) was the High Bidder in 24 of 30 hands, 6 exceptions: lines 7, 12, 16, 18, 28, & 30].
Double Pinochle: 25 cards: 11/; in 30 Cards: 2/.
Triple Pinochle in 25 cards: 1/; Triple Pinochle in 30 Cards: 1/; Total = 2
Player (1) is the high bidder and claimed the 5 kitty cards to tally additional melt in 24 of 30 hands. There are obvious exceptions, bidders (2) or (3) received melt noted in the first 25 cards and could be the highest bidder.

Player (1) is high bidder:

| | | | | | | | | | | | | | |
|---|---|---|---|---|---|---|---|---|---|---|---|---|---|
| 31 | | | | 29 | 35 | 33 | A, 10d/2-Qc/Kh | 43 | | | | | |
| 32 | Dr | | | 17 | 61 | 19 | A, K, Jc/Ks/Kd | 162 | | | | D | |
| 33 | | | | 23 | 35 | 46 | 2-A, 10c/K, Qs | 35 | | | | | (D) |
| 34 | | | | 35 | 25 | 51 | A, Ks/Kc/Kd/Qh | 47 | | | | | (D) |
| 35 | | | | 22 | 37 | 55 | 10, 2-Js/10d/Qh | 41 | | | | | (D) |
| 36 | (Jacks) | | | 50 | 24 | 20 | Ah/10, Qc/K, Jd | 65 | | | | | |
| 37 | Dr | | | 37 | 27 | 57 | As/10, Qc/Q, Jd | 170 | | | | | |
| 38 | Dr | | | 21 | 31 | 29 | 2-10, Qh/Jc/Js | 156 | | | | | |
| 39 | | | | 43 | 36 | 19 | A, Q, Jc/K, Jd | 73 | | | D | | |
| 40 | | | (Qu) | 23 | 25 | 113 | 2-10, Qd/Kh/Qc | 25 | | 125 | | | (D) |
| 41 | | | | 37 | 43 | 35 | A, K, Qs/10c/Kh | 41 | | | | | |
| 42 | Qu | | | 29 | 25 | 18 | A, Q, Js/2-Qc | 83 | | | | | |
| 43 | | (Aces) | | 31 | 116 | 35 | 10, 2-Qc/2-10h | 31 | 118 | | | | |
| 44 | | | | 107 | 23 | 43 | A, 10h/10c/Ks/Qd | 109 | | | (T) | | |
| 45 | Qu | | | 27 | 33 | 19 | Ah/2Qs/Qd/Jc | 83 | | | | | |
| 46 | | | | 17 | 25 | 6 | 2Q, Js/Qd/Jh | 23 | | | | | |
| 47 | | | | 8 | 29 | 27 | A, 2-10, Kd/Ac | 29 | | | | | |
| 48 | | (Aces) | | 39 | 104 | 33 | K, 2-Qs/10d/Jh | 71 | 117 | | D | | |
| 49 | | | | 26 | 20 | 4 | A, Kc/Ks/Kd/Qh | 33 | | | | | |
| 50 | | | | 23 | 31 | 10 | Ad/K, 10c/2-Qh | 39 | | | | | |
| 51 | Aces | | | 31 | 31 | 57 | A, 10, Ks/Ah/Ac | 133 | | | | | |
| 52 | | | | 29 | 35 | 6 | A, Q, Jd/Kh/Ks | 31 | | | | | |
| 53 | | | | 35 | 112 | 14 | A, 10s/2-Kh/Ks | 37 | 133 | | | (T) | |
| 54 | | | | 23 | 12 | 27 | 10d/Ks/Q, Jh/Qc | 25 | | | | | |

After 54 Hands: ( ) indicate doubles in 25 cards 54 hands: 7/13%; in 30 Cards: 9.
25 card doubles: Jacks: 1/ Queens: 1/ Kings: 2/ Aces: 2/ Double Runs: 1/.
(1) was high bidder in 44 of 54 hands, 10 exceptions are noted hands 7, 12, 16, 18, 28, 30, 40, 43, 48 & 53]
Double Pinochle in 25 Cards: 15/28% (11 + 4); in 30 Cards: 5/ (2 + 3)/
Total Double Pinochle in 54 hands: 20/37%.
Triple Pinochle in 25 Cards: 3/5%. Triple Pinochle in 30 cards: 1/54/ Total in 54 hands: 4/7%'
Player (1) is the High Bidder, there are obvious exceptions, (2) and (3) received the melt noted in the first 25 cards, either of them could be the highest bidder.

Player (2) is highest bidder

| | | | | | | | | | | | | | |
|---|---|---|---|---|---|---|---|---|---|---|---|---|---|
| 1 | | | | 23 | 48 | 14 | Ah/J, 2-Kc/Qs | | 67 | | | (D) | |
| 2 | | | | 33 | 17 | 12 | 2, 10d/2, Kd/Kc | | 29 | | | | |
| 3 | | Aces | | 34 | 39 | 18 | Ac/A, 10, Js/Jh | | 135 | | | | |
| 4 | | Kings | | 39 | 31 | 35 | A, 10, Qc/Ks/Jh | | 111 | | | | |
| 5 | | | | 25 | 39 | 25 | A, 10, Jh/Ks/Qd | | 39 | | | | |
| 6 | | | | 25 | 75 | 43 | 10, K, Qc/Qd/Jh | | 77 | | | (D) | |
| 7 | | | (Kings) | 4 | 61 | 101 | K, 10d/Ah/Ks/10c | | | 101 | | | |
| 8 | | | | 24 | 31 | 12 | 10, K, Jh/K, Qs | | 63 | | | D | |
| 9 | | | | 33 | 52 | 43 | Ad/10, Qc/Kh/Ks | | 73 | | | (D) | |
| 10 | | | | 31 | 39 | 25 | A, 10s/Ac/10, Qd | | 39 | | | | |
| 11 | | | | 27 | 41 | 19 | 10, 2K, Qd/Jh | | 47 | | | | |
| 12 | | (kings) | | 39 | 107 | 19 | A, Jh/Kd/2Qs | | 117 | | | | |
| 13 | | | | 34 | 25 | 18 | A, Kc/K, Qh/Kd | | 35 | | | | |
| 14 | | | | 25 | 20 | 31 | K, Js/10h/Jd/Jc | | 41 | | | | |
| 15 | | | | 8 | 23 | 34 | Q, 10d/2-10h/10s | | 27 | | | | |
| 16 | | kings | | 26 | 31 | 53 | Ah/2-K, Qc/Ks | | 113 | | | | (D) |
| 17 | | (Jacks) | | 61 | 55 | 16 | A, Ks/A, Jh/Jc | | 97 | | (D) | D | |
| 18 | | | | 12 | 61 | 41 | 10, Kd/10, Kc/Ks | | 69 | | | (D) | |
| 19 | | | | 12 | 22 | 61 | A, Js/Kc/10h/Jd | | | 61 | | | (D) |
| 20 | | | | 115 | 41 | 35 | A, Qc/K, Jh/Js | 115 | | | (T) | | |
| 21 | | | | 39 | 29 | 43 | A, Jc/10, Qs/Qd | | 45 | | | | |
| 22 | | | | 33 | 12 | 10 | A, 10, Kc/Ks/Qh | | 35 | | | | |
| 23 | | | | 17 | 27 | 16 | A, K, Qc/A, Jd | | 43 | | | | |
| 24 | | | | 39 | 31 | 33 | 2-Q, Jc/Js/Jh | | 39 | | | | |

-continued

STATISTICAL EVALUATION OF DOUBLE OCCURRENCES
ACTUAL MELT

| Hand | Doubles | | | Melt Before Kitty | | | | Bidder (1) is High Bidder (6 exceptions) | | | Pinochle Triple/P Double/P | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| 25 | | | | 25 | 25 | 27 | Ah/K, Q, Jd/Ks | | 33 | | | | |
| 26 | | jacks | | 59 | 19 | 16 | 10, 2Q, Jd/Ks | | 63 | | | | |
| 27 | | | | 34 | 33 | 2 | Ah/K, QJc/10d | | 35 | | | | |
| 28 | | | | 17 | 31 | 61 | A, K, Jh/2Qd | | | 61 | | | (D) |
| 29 | | | | 26 | 35 | 29 | A, 10, K, Qc/Ah | | 49 | | | | |
| 30 | | | (D-r) | 29 | 23 | 152 | 10, Kd/10, Qc/Qh | | | 170 | | | |

After 30 Hands: ( ) indicate doubles in 25 Cards 30 Hands: 4/13%; in 30 Cards: 4/.
25 card doubles Jacks: 1/ Queens: 0/ Kings: 2/ Aces: 0/ Double Runs: 1/. Total = 4
(2) was the High Bidder in 25 of the 30 hands, 5 exceptions: 7, 19, 20, 28 & 30.
Double Pinochle: 25 Cards: 8/27%; in 30 Cards: 2/ Total = 10.
Triple Pinochle in 25 Cards: 1/3% Triple Pinochle in 30 Cards: 0/ Total = 1
Player (2) is the High Bidder, there are obvious exceptions: bidders (1) or (3) received the melt noted in the first 25 cards,
either could be the highest bidder.

Player (2) is highest bidder:

| | | | | | | | | | | | | | |
|---|---|---|---|---|---|---|---|---|---|---|---|---|---|
| 31 | | | | 29 | 35 | 33 | A, 10d/2-Qc/Kh | | 41 | | | | |
| 32 | | kings | | 17 | 61 | 19 | A, K, Jc/Ks/Kd | | 137 | | | (D) | |
| 33 | | | | 23 | 35 | 46 | 2-A, 10c/K, Qs | | 67 | | | D | (D) |
| 34 | | | | 35 | 25 | 51 | A, Ks/Kc/Kd/Qh | | 41 | | | | (D) |
| 35 | | | | 22 | 37 | 55 | 10, 2-Js/10d/Qh | | | 63 | | | (D) |
| 36 | (Jacks) | | | 50 | 24 | 20 | Ah/10, Qc/K, Jd | 65 | | | | | |
| 37 | | | | 37 | 27 | 57 | As/10, Qc/Q, Jd | | 43 | | | | (D) |
| 38 | | | | 21 | 31 | 29 | 2-10, Qh/Jc/Js | | 33 | | | | |
| 39 | | | | 43 | 36 | 19 | A, Q, Jc/K, Jd | 73 | (71) | | (D) | D | |
| 40 | | | Qu | 23 | 25 | 113 | 2-10, Qd/Kh/Qc | | | 125 | | | (D) |
| 41 | | | | 37 | 43 | 35 | A, K, Qs/10c/Kh | | 76 | | | D | |
| 42 | | | | 29 | 25 | 18 | A, Q, Js/2-Qc | | 53 | | | | |
| 43 | | (Aces) | | 31 | 116 | 35 | 10, 2-Qc/2-10h | | 118 | | | | |
| 44 | | | | 107 | 23 | 43 | A, 10h/10c/Ks/Qd | 109 | | | (T) | | |
| 45 | | Dr | | 27 | 33 | 19 | Ah/2Qs/Qd/Jc | | 166 | | | | |
| 46 | | | | 17 | 25 | 6 | 2Q, Js/Qd/Jh | | 49 | | | D | |
| 47 | | | | 8 | 29 | 27 | A, 2-10, Kd/Ac | | 33 | | | | |
| 48 | | (Aces) | | 39 | 104 | 33 | K, 2-Qs/10d/Jh | | 117 | | (D) | | |
| 49 | | | | 26 | 20 | 4 | A, Kc/Ks/Kd/Qh | | 37 | | | | |
| 50 | | | | 23 | 31 | 10 | Ad/K, 10c/2-Qh | | 31 | | | | |
| 51 | | | | 31 | 31 | 57 | A, 10, Ks/Ah/Ac | | | 57 | | | |
| 52 | | | | 29 | 35 | 6 | A, Q, Jd/Kh/Ks | | 43 | | | | |
| 53 | | | | 35 | 112 | 14 | A, 10s/2-Kh/Ks | | 133 | | | (T) | |
| 54 | | | | 23 | 12 | 27 | 10d/Ks/Q, Jh/Qc | | 29 | | | | |

After 54 Hands: ( ) indicate doubles in 25 cards 54 Hands: 7/13%; Total in 30 Cards: 7/(7 + 7 = 14).
25 card doubles: Jacks: 2/ Queens: 0/ Kings: 2/ Aces: 2/ Double Runs: 1/.
(2) was the High Bidder in 43 of the 54 hands, 11 exceptions: lines 7, 19, 20, 28, 30, 35, 36, 39, 40, 44, & 51
Double Pinochle in 25 cards 54 hands: 16/(8 + 8) 30%; in 30 cards 54: 6/(2 + 4) 11%.
Total Double Pinochle in 54 hands: 22/41%. Triple Pinochle in 25 Cards 54 hands: 3/5%,
Triple Pinochle in 30 Cards: 0/ Total triple/Ps in 54 hands: 3/
Player (2) is the high bidder in 43 of 54 hands, there are obvious exceptions: bidders (1)
and (3) received the melt noted in 25 cards either could be the highest bidder.

Player (3) is highest bidder:

| | | | | | | | | | | | | | |
|---|---|---|---|---|---|---|---|---|---|---|---|---|---|
| 1 | | | | 23 | 48 | 14 | Ah/J, 2-Kc/Qs | | 67 | | | (D) | |
| 2 | | | | 33 | 17 | 12 | 2, 10d/2, Kd/Kc | | | 12 | | | |
| 3 | | | | 34 | 39 | 18 | Ac/A, 10, Js/Jh | | | 37 | (D) | | |
| 4 | | | | 39 | 31 | 35 | A, 10, Qc/Ks/Jh | | | 35 | | | |
| 5 | | | | 25 | 39 | 25 | A, 10, Jh/Ks/Qd | | | 31 | | | |
| 6 | | | D-r | 25 | 75 | 43 | 10, K, Qc/Qd/Jh | | | 178 | | (D) | |
| 7 | | | (kings) | 4 | 61 | 101 | K, 10d/Ah/Ks/10c | | | 101 | | (D) | |
| 8 | | | | 24 | 31 | 12 | 10, K, Jh/K, Qs | | | 14 | | | |
| 9 | | | | 33 | 52 | 43 | Ad/10, Qc/Kh/Ks | | | 43 | | (D) | |
| 10 | | | | 31 | 39 | 25 | A, 10s/Ac/10, Qd | | | 25 | | | |
| 11 | | | | 27 | 41 | 19 | 10, 2K, Qd/Jh | | | 35 | | | |
| 12 | | (kings) | | 39 | 107 | 19 | A, Jh/Kd/2Qs | | 117 | | | | |
| 13 | | | kings | 34 | 25 | 18 | A, Kc/K, Qh/Kd | | | 106 | | | |
| 14 | | | D-r | 25 | 20 | 31 | K, Js/10h/Jd/Jc | | | 166 | | | |
| 15 | | | | 8 | 23 | 34 | Q, 10d/2-10h/10s | | | 45 | | | |
| 16 | | | | 26 | 31 | 53 | Ah/2-K, Qc/Ks | | | 77 | | | (D) |
| 17 | | (Jacks) | | 61 | 55 | 16 | A, Ks/A, Jh/Jc | | 97 | | (D) | (D) | |
| 18 | | | | 12 | 61 | 41 | 10, Kd/10, Kc/Ks | | 69 | | | (D) | |
| 19 | | | | 12 | 22 | 61 | A, Js/Kc/10h/Jd | | | 61 | | | (D) |
| 20 | | | | 115 | 41 | 35 | A, Qc/K, Jh/Js | 115 | | | (T) | | |

-continued

STATISTICAL EVALUATION OF DOUBLE OCCURRENCES
ACTUAL MELT

| Hand | Doubles | | | Melt Before Kitty | | | | Bidder (1) is High Bidder (6 exceptions) | | | Pinochle Triple/P Double/P | | |
|---|---|---|---|---|---|---|---|---|---|---|---|---|---|
| # | 1 | 2 | 3 | 1 | 2 | 3 | 5 Card Kitty | 1 | 2 | 3 | 1 | 2 | 3 |
| 21 | | | | 39 | 29 | 43 | A, Jc/10, Qs/Qd | | | 51 | D | | |
| 22 | | | | 33 | 12 | 10 | A, 10, Kc/Ks/Qh | | | 28 | | | |
| 23 | | | | 17 | 27 | 16 | A, K, Qc/A, Jd | | | 33 | | | |
| 24 | | | Jacks | 39 | 31 | 33 | 2-Q, Jc/Js/Jh | | | 71 | | | |
| 25 | | | | 25 | 25 | 27 | Ah/K, Q, Jd/Ks | | | 27 | | | |
| 26 | | | | 59 | 19 | 16 | 10, 2Q, Jd/Ks | 133 | | | T | | |
| 27 | | | | 34 | 33 | 2 | Ah/K, QJc/10d | | | 33 | | | |
| 28 | | | | 17 | 31 | 61 | A, K, Jh/2Qd | | | 61 | | | (D) |
| 29 | | | | 26 | 35 | 29 | A, 10, K, Qc/Ah | | | 45 | | | |
| 30 | | | (D-r) | 29 | 23 | 152 | 10, Kd/10, Qc/Qh | | | 170 | | | |

After 30 Hands: ( ) indicate doubles in 25 cards 30 hands: 4/13%; in 30 cards: 4/.
25 card doubles: Jacks: 1/ Queens: 0/ Kings: 2/ Aces: 0/ Double Runs: 1/.
(3) was the High Bidder in 24 of the 30 hands, 6 exceptions: hands 1, 12, 17, 18, 20, & 26.
Double Pinochle: 25 Cards 11/37% In 30 cards 1/30/ Total = 12
Triple Pinochle in 25 Cards: 1/3% Triple Pinochle in 30 Cards: 1/3%/ Total = 2
Only one high bidder receives 5 kitty cards to tally additional melt.

Player (3) is highest bidder:

| | | | | | | | | | | | | | |
|---|---|---|---|---|---|---|---|---|---|---|---|---|---|
| 31 | | | | 29 | 35 | 33 | A, 10d/2-Qc/Kh | | | 35 | | | |
| 32 | | kings | | 17 | 61 | 19 | A, K, Jc/Ks/Kd | | 137 | | | | |
| 33 | | | | 23 | 35 | 46 | 2-A, 10c/K, Qs | | | 52 | | | (D) |
| 34 | | | | 35 | 25 | 51 | A, Ks/Kc/Kd/Qh | | | 61 | | | (D) |
| 35 | | | | 22 | 37 | 55 | 10, 2-Js/10d/Qh | | | 63 | | | (D) |
| 36 | (Jacks) | | | 50 | 24 | 20 | Ah/10, Qc/K, Jd | 65 | | | | | |
| 37 | | | Qu | 37 | 27 | 57 | As/10, Qc/Q, Jd | | | 171 | | | (D)T |
| 38 | | | | 21 | 31 | 29 | 2-10, Qh/Jc/Js | | | 35 | | | |
| 39 | | | | 43 | 36 | 19 | A, Q, Jc/K, Jd | 73 | (71) | | D | D | |
| 40 | | | (Qu) | 23 | 25 | 113 | 2-10, Qd/Kh/Qc | | | 125 | | | (D) |
| 41 | | | | 37 | 43 | 35 | A, K, Qs/10c/Kh | | | 61 | | | D |
| 42 | | | | 29 | 25 | 18 | A, Q, Js/2-Qc | | | 33 | | | |
| 43 | | (Aces) | | 31 | 116 | 35 | 10, 2-Qc/2-10h | | 118 | | | | |
| 44 | | | | 107 | 23 | 43 | A, 10h/10c/Ks/Qd | 109 | | | (T) | | |
| 45 | | | | 27 | 33 | 19 | Ah/2Qs/Qd/Jc | | | 65 | | | D |
| 46 | | | | 17 | 25 | 6 | 2Q, Js/Qd/Jh | | | 51 | | | D |
| 47 | | | | 8 | 29 | 27 | A, 2-10, Kd/Ac | | | 27 | | | |
| 48 | | (Aces) | | 39 | 104 | 33 | K, 2-Qs/10d/Jh | | 117 | | (D) | | |
| 49 | | | | 26 | 20 | 4 | A, Kc/Ks/Kd/Qh | | | 14 | | | |
| 50 | | | | 23 | 31 | 10 | Ad/K, 10c/2-Qh | | | 18 | | | |
| 51 | | | | 31 | 31 | 57 | A, 10, Ks/Ah/Ac | | | 57 | | | |
| 52 | | | | 29 | 35 | 6 | A, Q, Jd/Kh/Ks | | | 41 | | | |
| 53 | | | | 35 | 112 | 14 | A, 10s/2-Kh/Ks | | 133 | | | (T) | |
| 54 | | | | 23 | 12 | 27 | 10d/Ks/Q, Jh/Qc | | | 27 | | | |

After 54 Hands: ( ) indicate doubles in 25 cards 54 hands: 8/15%; total in 30 cards: 6/.
25 card doubles: Jacks: 2/ Queens: 1/ Kings: 2/ Aces: 2/ Double Runs: 1/.
(3) was the High Bidder in 41 of the 54 hands, 13 exceptions: 1, 12, 17, 18, 20, 26, 32, 36, 39, 43, 44, 48, & 53. Double Pinochle in 25 cards 54 hands: 17/31% (11 + 6) in 30 Cards: 6/(3 + 3)/.
Total Double Pinochle in 54 hands: 23/42%, high bidder had 11 double Ps & 1 triple/P.
Triple Pinochle in 25 Cards: 3/54/. Triple Pinochle in 30 cards 54 hands: 1/
Total triple/Ps in 54 hands: 5/9%
Player (3) is the high Bidder in 41 of 54 hands, high bidder had 11 double & 1 triple/P.
There are obvious exceptions, bidders (1) and (2) received the melt noted in the first 25 cards, either could be the highest bidder.

Recap Follows:

Recap of Statistical Occurrences Under This New Invention

Under this invention, the foregoing evaluations depicting theoretical statistics on Melt (points) and the decremented schedules containing the actual Melt (points) provide a factual basis in regard to wager odds for this new invention, "Three Hand Pinochle."

Regarding theoretical statistics, the schedules reflect the range of game results as viewed from the perspective of each of the three players. After the 5 kitty cards are awarded to the highest bidder, the other two players, at this eureka point, will either highly value their wisdom or groan about apparent lack of wisdom for a no bid decision, when their sought after card is in the kitty. The 5 kitty cards either confirm a bidder's justification for bids higher than their first 25 cards support or justify bidder ambivalence for not rendering a higher bid.

When the bidder's sought after card(s) is not in the kitty, it could result in the bidder going set for the bid amount—to the glee of the other bidders. But, regardless of negative outcomes, under this invention, a consistent winner must be thoroughly proficient in bid logic to consistently tally winning melt points. The typical statistical results of this game tend to consistently show that the melt one seeks is "indeed" often in the kitty.

The six decremented schedules in our example reflect actual 25 cards melt points as well as 30 cards "Pinochle and doubles Melt" for high bidders, therefore, a recap of these results appears to be the best statistical indicator to base table wager odds on—under this invention, the results are the "Real Deal." As important, when a wager on a double possibility is successful, [average 5% double around rate in first 25 cards for Aces, Kings, Queens, Jacks and triple pinochle-range is 3.7 to 6.7%] the return to the wage maker could be 15-17 to 1, more than equating to the minimum 75% return on wager goal to the wage maker. The average instance of "Double Runs" is slightly higher, 6% with 10-13 to 1 wager odds—as determined by the house—further enhancing the appeal of this action packed game with titillating high and low expectations in a win/win scenario where for every 54 players 6 are winners.

Statistics follow: Regarding incidents of doubles in first 25 cards and instances of high bidder double and triple pinochle combinations. Note that exceptions to the presumed high bidders are noted in the schedules, the statistical effect can be separately determined but is factored in here under high bidder results, as it is only the high bidder who can gain melt advantage through the five kitty cards, for example, more cards to tally doubles around and pinochle melt.

Payout on double around wagers: As supported by the below statistics, Aces, Kings, Queens and Jacks—4 each per suit, 16 per deck—have an averaged 5% double occurrence rate. Using 5% as the average i.e., individual doubles occurring at an average rate of 1 in 20 hands command a pay out between 15 and 17 to 1, as preferred by the house, to meet or better the average 75% return on wager goal.

Pay out on double runs: As supported by the below statistics, two of each cards in a suit—each four suits contains 20 cards—equates to double runs occurring at a slightly higher rate, 6% occurrence, than doubles around. Using 6% as the average i.e., double runs occur at a rate of 10 occurrences for 162 hands, commands a pay out between 10-13 to 1, as preferred by the house, to meet or better the average 75% return on wager goal. Payout on double pinochles: As supported by the below statistics, four queens of spades and four jacks of diamonds in a deck result in one or two players having, within the first 25 cards, two queens of spades and two jacks of diamonds at a 39% rate of occurrence [21 divided by 54]. Using 39% as the average i.e., one pinochle for every 2.56 hands, commands a pay out of 2 to one, without exception, to meet or better the 75% return on wager goal. The slight advantage for high bidders, gained from having five additional cards, does not change the reality that "only two players can have double pinochle in the same hand," therefore, the 2 to 1 payout remains the same and is an added inducement for the double pinochle wager.

Pay out for triple pinochle: As supported by the below statistics, one player having three queens of spades and three jacks of diamonds within 25 cards—or 30 cards if high bidder—occurred at a average rate of 3 occurrences in 25 cards 54 hands or at a 5% rate and 1 in 30 cards 54 hands for an equivalent rate of 1.8%. The occurrence in first 25 cards payout rate is also computed to be 15-17 to 1, and the high bidder wager payout is without regard to 25 or 30 cards and computed at a 20 to one payout to represent a potential bonanza for the successful high bidder.

| | Statistical Odds | | | | | | |
|---|---|---|---|---|---|---|---|
| | 54 Hands | | 54 Hands | | 54 Hands | | 162 Hands |
| | 25 Cards | 30 Cards | 25 Cards | 30 Cards | 25 Cards | 30 Cards | Total Instances |
| Doubles | Player 1 High | | Player 2 High | | Player 3 High | | All 3 |
| Jacks | 1 | 1 | 2 | 1 | 2 | 1 | 8/162: 4.9% |
| Queens | 1 | 2 | 0 | 1 | 1 | 1 | 6/162: 3.7% |
| Kings | 2 | 0 | 2 | 3 | 2 | 2 | 11/162: 6.7% |
| Aces | 4 | 2 | 2 | 1 | 2 | 0 | 11/162: 6.7% |
| Double Run | 1 | 4 | 1 | 1 | 1 | 2 | 10/162: 6% |
| Double/P | 15 | 5 | 16 | 6 | 17 | 6 | 65/162: 40% |
| Triple/P | 3 | 1 | 3 | 0 | 3 | 2 | 12/162: 7% |

The double pinochle percentage is averaged at 21/54; Triple Pinochle occurrence percentage of 7% is based on the occurrences in the 162 hands of the evaluation, with our regard to 25 or 30 card criteria, otherwise the triple/P 25 card percentage is calculated at 3/54 or 5%. Therefore: Double/P = 21/54, Average = 39% and Triple/P = 12/162 for an overall Average of 7%; but the 25 card 54 hand average is 5%.

CONCLUSION

In sum, the casino-adapted Three Hand Pinochle game of the present invention is action packed with titillating highs and lows. On average, for every fifty-four players, six will be winners. As such, the odds of winning are favorable to players, and the payout schedule reserves an appropriate amount of profit for the gaming establishment.

Although the above description and accompanying drawings and schedules relate to specific preferred embodiments as presently contemplated by the inventor, it will be understood that the invention in its broad aspect includes mechanical and theoretical equivalents of the elements described and illustrated.

MELT TABULATOR
REVIEW YOUR 25 CARDS AND ENTER MELT IN COLUMN ONE THROUGH EIGHT AS FOLLOWS:

| 1 | 2 | 3 | 4 | 5 | 6 | 7 | 8 |
|---|---|---|---|---|---|---|---|
| ACES: 10 POINTS | | | | DOUBLE ACES: 100 POINTS | | | |
| ONE ACE IN EACH SUIT | | | | TWO ACES IN EACH SUIT | | | |
| | | | | | | | |
| KINGS: 8 POINTS | | | | DOUBLE KINGS: 80 POINTS | | | |
| ONE KING IN EACH SUIT | | | | TWO KINGS IN EACH SUIT | | | |
| | | | | | | | |
| QUEENS: 6 POINTS | | | | DOUBLE QUEENS: 60 POINTS | | | |
| ONE QUEEN IN EACH SUIT | | | | TWO QUEENS IN EACH SUIT | | | |
| | | | | | | | |

-continued

MELT TABULATOR
REVIEW YOUR 25 CARDS AND ENTER MELT IN COLUMN ONE THROUGH EIGHT AS FOLLOWS:

| JACKS: 4 POINTS | DOUBLE JACKS: 40 POINTS |
|---|---|
| ONE JACK IN EACH SUIT | TWO JACKS IN EACH SUIT |

| | | | | | | | |
|---|---|---|---|---|---|---|---|
| | | | | | | | |

ROUND HOUSE: 24 POINTS ROUND HOUSE + DOUBLE RUN

A MIRRAGE (KING & QUEEN) IN EACH SUIT (150 + 20):= 170 POINTS

| | | | | | | | |
|---|---|---|---|---|---|---|---|
| | | | | | | | |

| SINGLE RUN: 15 POINTS | DOUBLE RUN: 150 POINTS |
|---|---|
| ACE/TEN/KING/QUEEN/ JACK: IN TRUMPS | DOUBLE/ACE/TEN/KING/ QUEEN/JACK/: IN TRUMP |

| | | | | | | | |
|---|---|---|---|---|---|---|---|
| | | | | | | | |

MARRIAGE:TRUMP: 4 POINTS MARRIAGE NOT TRUMP: 2 POINTS

| | | | | | | | |
|---|---|---|---|---|---|---|---|
| | | | | | | | |

| LITTLE PINOCHLE: 4 POINTS | BIG PINOCHLE: 30 POINTS |
|---|---|
| JACK OF DIAMONDS + QUEEN OF SPADES | TWO JACKS OF DIAMONDS + TWO QUEEN OF SPADES |

| | | | | | | | |
|---|---|---|---|---|---|---|---|
| | | | | | | | |

TRIPPLE PINOCHLE: 90 POINTS

THREE JACKS OF DIAMONDS + THREE QUEENS OF SPADES

| | | | | | | | |
|---|---|---|---|---|---|---|---|
| | | | | | | | |

ROUND HOUSE AND A RUN: 35 POINTS

MARRIAGE IN EACH SUIT + ACE/TEN/KING/QUEEN/JACK: IN SUIT NAMED TRUMPS

| | | | | | | | |
|---|---|---|---|---|---|---|---|
| | | | | | | | |

TOTALS:

| | | | | | | | |
|---|---|---|---|---|---|---|---|
| | | | | | | | |

What I claim as my invention is:

1. A method of playing a casino-adapted card game, comprising:

(a) three player groups;

(b) providing a pinochle type game where each individual is in full control of decisions without regard decisions of his opponents (c) three person groups in a contest to win 2 of four games in a game set twice (d) distributing a hand of twenty-five cards to each player and distributing five cards face down to a kitty area of a gaming table;

(e) each player bidding to win the kitty cards to name a trump of choice and tally melt to the game's threshold of either 250 or 500 points (f) tallying the melt and card points of each player based on said assigned point values; and (g) paying successful wagers a preselected odds based amount in accordance with a statistically derived pay-out schedule.

2. The method of claim 1 wherein each of said groups consists of three players.

3. The method of claim 2 having from nine to fifty-four players.

4. The method of claim 3 further comprising eliminating players unsuccessful in obtaining said determined winning score in a round of play, and advancing one or more players obtaining said winning score.

5. The method of claim 2 having fifty-four players.

6. The method of claim 1 having from six to fifty-four players.

7. The method of claim 1 wherein each of said books comprises at least three cards.

8. The method of claim 7 further comprising forfeiting the points of a player that attempts to best a card played to a book where said player has the ability to best said card but fails to do so.

9. The method of claim 1 further comprising limiting successive wagering of a player achieving a negative point score to a difference in amount between said negative score and the game score.

10. The method of claim 1 further comprising accepting a double or a triple wager at the outset of the hand from a player that wins said kitty cards.

11. The method of claim 1 further comprising forfeiting the points of a player that fails to best a high card played to a book where said player has the ability to best said card.

12. The method of claim 1 further comprising reducing accumulated points of a player that fails to score the minimum number of points represented by said bid amount.

13. The method of claim 1 further comprising accepting wagers from players prior to distribution of said cards.

14. The method of claim 1 wherein said preselected amount is paid based on a pay out schedule.

15. The method of claim 1 wherein said game table comprises a surface imprinted with indicia designating a dealer area, player areas, kitty card placement areas, hold card and book placement area, double wagers and triple wager areas.

16. The method of claim 15 having six player designated areas.

17. The method of claim 15 wherein the imprinted indicia further includes payout odds for obtaining certain combinations of cards.

* * * * *